US007965178B1

(12) United States Patent
Schmuttor et al.

(10) Patent No.: US 7,965,178 B1
(45) Date of Patent: Jun. 21, 2011

(54) SYSTEM AND METHOD FOR INTEGRATED FACILITY AND FIREGROUND MANAGEMENT

(76) Inventors: Bruce E. Schmuttor, Brooklyn, NY (US); David B. McCauley, Adamstown Heights (AU)

( * ) Notice: Subject to any disclaimer, the term of this patent is extended or adjusted under 35 U.S.C. 154(b) by 336 days.

(21) Appl. No.: 11/714,392

(22) Filed: Mar. 5, 2007

Related U.S. Application Data

(63) Continuation-in-part of application No. 11/528,181, filed on Sep. 26, 2006, now abandoned.

(60) Provisional application No. 60/720,609, filed on Sep. 26, 2005.

(51) Int. Cl.
*G08B 29/00* (2006.01)

(52) U.S. Cl. ... 340/506; 340/521; 340/531; 340/539.27; 340/577; 340/588; 340/628; 340/632; 702/127

(58) Field of Classification Search ..... 340/506, 340/521, 531, 539.27, 577, 584, 588, 628, 340/632; 250/339.05, 339.15; 700/1, 19; 702/127; 701/127
See application file for complete search history.

(56) References Cited

U.S. PATENT DOCUMENTS

| | | | | |
|---|---|---|---|---|
| 4,023,139 | A | 5/1977 | Samburg | |
| 4,635,040 | A | 1/1987 | Masot | |
| 5,165,465 | A | 11/1992 | Kenet | |
| 5,316,484 | A | 5/1994 | Layton et al. | |
| 5,374,191 | A | 12/1994 | Herman et al. | |
| 5,493,271 | A | 2/1996 | Kobayashi et al. | |
| 5,990,793 | A | 11/1999 | Bieback | |
| 6,072,396 | A | 6/2000 | Gaukel | |
| 6,100,806 | A | 8/2000 | Gaukel | |
| 6,563,910 | B2 * | 5/2003 | Menard et al. | 379/45 |
| 6,958,689 | B2 | 10/2005 | Anderson et al. | |
| 7,066,297 | B2 | 6/2006 | Goodman et al. | |
| 7,130,757 | B2 | 10/2006 | Corwin et al. | |
| 7,292,142 | B2 * | 11/2007 | Simon et al. | 340/539.17 |
| 2002/0008625 | A1 | 1/2002 | Adams et al. | |
| 2002/0138663 | A1 | 9/2002 | Ladwig | |
| 2002/0153854 | A1 | 10/2002 | Reed et al. | |
| 2002/0163486 | A1 | 11/2002 | Ronzani et al. | |
| 2002/0196202 | A1 | 12/2002 | Bastian et al. | |
| 2003/0069002 | A1 | 4/2003 | Hunter et al. | |
| 2003/0125998 | A1 | 7/2003 | McKenney et al. | |
| 2003/0127541 | A1 | 7/2003 | Marino | |
| 2003/0214397 | A1 | 11/2003 | Perkins et al. | |
| 2004/0012491 | A1 | 1/2004 | Kulesz et al. | |
| 2004/0070515 | A1 | 4/2004 | Burkley et al. | |
| 2004/0103431 | A1 | 5/2004 | Davenport et al. | |
| 2004/0174269 | A1 | 9/2004 | Miller et al. | |
| 2005/0001720 | A1 | 1/2005 | Mason et al. | |
| 2005/0017070 | A1 | 1/2005 | Miller et al. | |
| 2005/0200453 | A1 * | 9/2005 | Turner et al. | 340/5.61 |
| 2005/0213155 | A1 | 9/2005 | Ciccarelli | |
| 2006/0158329 | A1 | 7/2006 | Burkley et al. | |
| 2006/0211404 | A1 | 9/2006 | Cromp et al. | |

OTHER PUBLICATIONS

Snoonian-D., "Smart Buildings," IEEE Spectrum, Aug. 2003, pp. 18-23.

* cited by examiner

*Primary Examiner* — Hung T. Nguyen
(74) *Attorney, Agent, or Firm* — Nixon Peabody LLP

(57) ABSTRACT

The present invention provides an intelligent, integrated facility and fireground management system which is efficient, assures first responder, pedestrian and appliance safety, as well as precise performance in extreme emergency situations, regulatory compliance, easy and flexible integration with building systems and add-on components, as well as advanced internal component monitoring and event logging. The present invention additionally provides systems and method for real-time first responder situational awareness and real-time fireground situational awareness.

27 Claims, 22 Drawing Sheets

Door States

1100

Door Mode Priority Conflict Management Design Criteria

| Mode | Requires | Description | I-Special I/O Valid Hardware | I-Special Entity Environment | I-Special Instruct Channel | G-Manual Key | I-Ext. Wall Button | I-Int. Wall Button | I-Remote Station | I-Open Sensor | I-Safety Sensor | O-Electric Strike | O-A/V Announce | O-Power Assist | O-Restrict Passage |
|---|---|---|---|---|---|---|---|---|---|---|---|---|---|---|---|
| Power Loss | Non / Default | Allow Free, Unhindered Egress and Authority Entry Only | N/A | N/A | N/A | Required | N/A | N/A | N/A | N/A | N/A | Engaged | N/A | N/A | N/A |
| Hazard | Triggered By Environment Or Instruction Input | Will Modify Standard Course Of Action Based Upon Environmental Sensors Or Revised Validated Instructions From Onsite Distributed Journal Audit Units | Accept | Accept | Accept | Required | Ignored | Ignored | Ignored | Ignored | Ignored | Engaged | Alarm Message | Bypass | On |
| Loss of Confidence | Pole I/O | Unable To Validate INPUTS Or Outputs System Enters Default Mode | Unknown | Unknown | Unknown | Required | Unknown | Unknown | Unknown | Unknown | Unknown | N/A | N/A | N/A | N/A |
| Unsafe | Inability To Control Outputs As Intended | Logic 100% Mechanical Has Problems; If No Alternate Work Around Then System Enters Default State | N/A | N/A | N/A | Required | N/A | N/A | N/A | N/A | N/A | Engaged | Alarm Message | N/A | N/A |
| Fire Alarm | Fire Alarm | Allow Free, Unhindered Travel From Either Side And With Power Assist To Accommodate High Traffic Levels/ADA Compliance | Accept | Accept | Accept | Not Required | Accept | Accept | Accept | Accept | Accept | Retracted | Off | Available | Bypass |
| Patient Alarm | No Fire Alarm | Restrict Passage Or Annunciate As Per Code Triggered By Proximity Of Patient ID Wireless Tag | Accept | Accept | Accept | Optional | Ignored | Ignored | Ignored | Ignored | Accept If Door Is Open Upon Receipt of Patient Alarm | Engaged | On | Bypass | On |
| Holy Days/ Calendar Event | No Fire Alarm, No Patient Alarm | Allow Free, Unhindered Trave With Manual Door Operation Or By Knowing Act | Accept | Accept | Accept | Optional | Accept | Accept | Accept | Ignored | Available Only Via Knowing Act | Follows Night Mode | Follows Patient Alarm | Availa ble Only Via Knowing Act | Follows Patient Alarm |
| Night | No Fire Alarm, No Patient Alarm | Allow Free, Unhindered Egress And Authorized Entry With Power Assist To Accommodate High Traffic Levels/ADA Compliance | Accept | Accept | Accept | Optional | Ignored | Accept | Accept | Ignored | Accept With Excess Door Open Time | Engaged | Follows Patient Alarm - Or Excess Door Open Time | Available | Follows Patient Alarm |

Figure 14A

Door Mode Priority Conflict Management Design Criteria

| Mode | Requires | Description | I-Special I/O Valid Hardware | I-Special Entity Environment | I-Special Instruct Channel | G-Manual Key | I-Ext. Wall Button | I-Int. Wall Button | I-Remote Station | I-Open Sensor | I-Safety Sensor | O-Electric Strike | O-A/V Announce | O-Power Assist | O-Restrict Passage |
|---|---|---|---|---|---|---|---|---|---|---|---|---|---|---|---|
| Day | No Fire Alarm, No Patient Alarm And Not Night | Allow Free, Unhindered Travel From Either Side And With Power Assist To Accommodate High Traffic Levels/ADA Compliance | Accept | Accept | Accept | Not Required | Accept | Accept | Accept | Accept | Accept | Retracted | Follows Patient Alarm | Available | Follows Patient Alarm |
| Tampering/ Maintenance | Unqualified Access Opening To Control Device | User Attempts to Place System Into Maintenance Or Test Mode Authorization Requires Both A PIN And The System To Be In An Idle State | Accept | Accept | Accept | Required | Accept | Accept | Accept | Accept | Accept | Follows Night Mode | Silent Remote Alarm | Available | Follows Night Mode |
| Test/Repair/And Commission | No Fire Alarm, No Patient Alarm, No Environmental Hazards And Idle State | Authorized Human Intervention Performing Inspection, Repair, Or Commissioning | Accept | Accept | Accept | Optional | Accept | Accept | Accept | Accept | Accept | User Controlled | User Controlled | User Controlled | User Controlled |
| Off | No Fire Alarm, No Patient Alarm, No Environmental Hazards And Idle State | Desired Not To Move However System 100% | Accept | Accept | Accept | Required | Ignored | Ignored | Ignored | Ignored | Ignored | Engaged | N/A | N/A | N/A |

G = General Hardway Input Device O = Output Device

Figure 14B

| | User interface Design | |
|---|---|---|
| User Groups | Test | Interface |
| Manufacturer | Require user id and pin | OEM Interface |
| Installer | Require user id and pin | Signal Set Verification |
| Commision engineer | Require user id and pin | Validated plug and play component selections |
| Repair tech | Require user id and pin | Diagnostic Software with ability to mask specific Variable for Isolation Purposes |
| Client Admin | Require user id and pin | journal audit logs and various compliance report options |
| General Client Staff | Require user id and appropriate time period | A/V Realtime Messenging |
| General Public | Requires them to utilize system in the intended manner | A/V Realtime Messeging |
| Government Inspect | Require user id and pin | Appropriate report menu |
| Responder Emergency | Require user id | Adjacent Enviormental Realtime Status Updates |
| Vandal | Singular unauthorized activity to non-life threatening systems | Local/Silent Alarm |
| Terrorist | multiple unauthorized activity to non-life threatening systems or single unauthorized activity to a life threatening system | Silent Alarm |

Figure 15

System States

Here is a quasi C program

```
enum DoorStates
{
    DoorStateUnknown = 0,
    DoorStateOpened,            // = 1
    DoorStateAboutToClose,
    DoorStateClosing,
    DoorStateClosed,
    DoorStateAboutToOpen,
    DoorStateOpening,           // = 6
    DoorStateDisconnected,
    DoorStateBlocked
}

Solve()
{
    int   nDoorState = DoorStateUnknown;
    int   nLastDoorState = DoorStateUnknown;
    long lCloseStartTime;
    long lClosingTime;
    long lOpenStartTime;

    while ( 1 )
    {
        GetInputs();

        switch ( nDoorState )
        {
        case DoorStateUnknown:
            if ( iDisconnectLeft || iDisconnectRight )
                nDoorState = DoorStateDisconnected;
            else if ( iSafetyReverse )
                nDoorState = DoorStateBlocked;
            else if ( iOpenPosition == 0 )
                nDoorState = DoorStateOpened ;
            else if ( iClosePosition == 0 )
                nDoorState = DoorStateClosed;
            else
                nDoorState = DoorStateUnknown;
            break;

        case DoorStateOpened:
            if ( nLastDoorState == DoorStateUnknown || nLastDoorState == DoorStateOpening )
            {
                if ( iFire || iSuperviseClose )
                {
                    nDoorState = DoorStateAboutToClose;
                }
            }
            else
            {
                // We can only get to DoorStateOpened from DoorStateOpening orDoorStateUnknown
                // Something is wrong
            }
            break;

        case DoorStateAboutToClose:
            if ( nLastDoorState == DoorStateOpened )
            {
                qVoiceA = 1;      // Annunciate
                qClose = 1;
            }
            if ( iCloseContactorUp )
            {
                nDoorState = DoorStateClosing;
            }
            break;

        case DoorStateClosing:
            if ( iClosedPosition == 0 )
            {
                nDoorState = DoorStateClosed;
            }
            else
            {
                if ( iDisconnectLeft || iDisconnectRight )
                {
                    // Uo-oh, door is disconnted while we are driving it
                }
                else if ( nLastDoorState == DoorStateAboutToClose )
                {
                    // First time, so get start time
                    lCloseStartTime = time();
                }
                else
                {
                    // See how long we have been closing
                    lClosingTime = time() - lStartCloseTime;
                    if ( lClosingTime > 40 secs )
                    {
                        // Stalled - do something
                    }
                }
            }
            break;

            // Do the same for door opening here
        }

        PutOutputs();

        nLastDoorState = nDoorState;
    }
}
```

Figure 16C

SYSTEM AND METHOD FOR INTEGRATED FACILITY AND FIREGROUND MANAGEMENT

CROSS-REFERENCE TO RELATED APPLICATIONS

This application is a continuation-in-part of U.S. application Ser. No. 11/528,181 filed Sep. 26, 2006, which claims the benefit of U.S. Provisional Application Ser. No. 60/720,609, filed on Sep. 26, 2005, both of which are incorporated herein by reference in their entirety.

FIELD OF THE INVENTION

The present invention is related to systems and devices for intelligent, integrated facility and fireground management, and systems for real-time first responder and fireground situational awareness.

BACKGROUND OF THE INVENTION

Intelligent management of safety and access control issues is becoming increasingly important for all types of public and private facilities. Accordingly, an increasing number of facility appliances such as barriers (doors, windows, etc.), elevators, heating ventilation and air conditioning (HVAC) systems, power generation systems, alarms, fire dampers, and lighting systems are being equipped with sophisticated recognition and key systems. Another factor behind the increasing complexity of facility appliances is growing integration of entrances and exits with diverse building and management systems. Examples range from central fire alarm/emergency systems to time and attendance terminals and networked security devices that provide data to a common building monitoring database. In short, there is a growing recognition in the facility management industry of the escalating convergence between mechanical products, electronic components and software/information technology (IT) capabilities.

Automatic door systems provide one example of a facility appliances in need of a more intelligent, integrated management system. Current automatic door systems have numerous and significant deficiencies. For example, current systems do not accurately ensure protection of pedestrians when one or more of the door's components are disengaged, and even if the automatic door system does provide such protection, the system likely will not automatically reset the door and re-engage the components. Further, if a current automatic door system has disengaged components, most cannot communicate with the user/pedestrian and/or facility maintenance staff, and even if such doors have a communicating system, they do not have diagnostic logging which allows quick and efficient identification of the problem component(s).

Currently available automatic door systems contain problems with sensors including inappropriate reading of sensors, incorrect locked out time periods of sensor signals, and difficulty in interpreting interrelated sensor signals. For instance, if eight sensors are connected for one purpose, current systems cannot determine which of the eight sensors have triggered a specific occurrence.

Importantly, current automatic door systems lack a central decision making structure which is capable of prioritizing the system outputs in conjunction with global alarms or time periods. For example, if a current automatic door enters into night/secure mode while the door is open, the door sensor may or may not respond to sensor input. Current automatic doors also possess insufficient motor and mechanical overload, which translate into pedestrian injury.

Additionally, current automatic door systems provide no provision for maintenance key/mode. Accordingly, many sensors need to be power cycled in order to recalibrate. Another salient shortcoming of current automatic door systems is their inability to differentiate between parallel pedestrian traffic (people walking past an automatic door) vs. perpendicular pedestrian traffic (pedestrians walking to the door with the intent to go through the door). This results in unnecessary power usage and door component wear.

Currently available automatic door systems lack the ability to communicate to users and facility staff what mode the door is in. This results in pedestrian/staff confusion, increased abuse/damage to the door, as well as increase potential for pedestrian injury. Additionally, current automatic door systems do not have calendar integration for schematic calendar events, and thus lack a central integration system to coincide with Life Safety Code or other accreditation requirements. Current automatic door systems also lack localized fuse, circuit breaker, and surge protection.

Current systems also lack administrative ability. Many are unable to correctly interpret activation signals and wall paddle devices. Most current systems will continue to cycle if wall paddle is depressed and not reset at the initial depression of the wall device. Current systems are not focused on the total picture of environment care in regards to reentry, egress, smoke/fire compartmentalization and patient/employee safety care including infant abduction, elder/wander protection and visitor/guest control. Additionally, most current systems cannot override specific door components, and lack diagnostic ability, logging/journaling, and a temporary ability to override for commissioning (set up) or maintaining door systems. Current systems also do not allow scenario based modeling and the ability to test with true-to-life scenarios. Current systems additionally lack the ability to easily modify time and/or integrated settings, e.g., time required to ensure the electrical locking system is unlatched prior to opening of door. Current systems do not provide visual and audio communicators to alert pedestrians in an event of a fire or other emergency. Finally, current systems cannot communicate which component has a problem because there is no logging feature. This results in significant time and energy being wasted in determining the specific problem.

Numerous door control products currently exist which offer door control relays and software solutions that allow networked integration of time and attendance and security system data from terminals installed at entrance/exit door locations. However, all of these products lack sophisticated integration, diagnostics and configurable logic capability. Other existing building automation systems provide functionality ranging from central control and monitoring to remote troubleshooting by the manufacturer's support staff. TORMAX UNINET™ is one such example. However, these systems are limited to networking doors to central terminals for data collection and execution of functions that are derivative from, or based on, typical functions of automatic door remote control units.

Other existing barrier management related provide programmable PC-based I/O controllers. However, although such products offer programmable control functionality, they lack provisions for hardware components, asset monitoring and diagnostics/event logging or journaling. Further, such products do not include any rules-based software or built-in logic capabilities.

Current building management systems also lack features critical in emergency management, including fireground management. First responders on the scene of an emergency such as a fire must quickly assess the most critical fireground factors in deciding how most effectively to deploy fire fighters, attack the fire, rescue victims and preserve property. Efforts must continue throughout the operation to update and improve upon initial information relating to these factors. Fireground factor information comes from three broad sources: visual, reconnaissance and preplanning. Currently, reconnaissance typically involves sending someone into the structure to report on conditions as they are encountered.

In its NCSTAR 1: Federal Building and Fire Safety Investigation of the World Trade Center Disaster: Final Report of the National Construction Safety Team on the Collapses of the World Trade Center Tower, NIST recommended (recommendations 13, 14 and 23): (1) That fire alarm and communications systems in buildings be developed to provide continuous, reliable, and accurate information on the status of life safety conditions at a level of detail sufficient to manage the evacuation process in building fire emergencies; (2) That control panels at fire/emergency command stations in buildings be adapted to accept and interpret a larger quantity of more reliable information from the active fire protection systems that provide tactical decision aids to fire-ground commanders; and (3) The establishment and implementation of detailed procedures and methods for gathering, processing, and delivering critical information through integration of relevant voice, video, graphical, and written data to enhance the situational awareness of all emergency responders. The systems and methods currently used by fire fighters fail meet one or more of the NIST's recommendations.

Currently, fire fighters commonly wear Personal Alarm Safety Systems (PASS) warning devices which are audible warning devices designed to activate if a fire fighter remains motionless for a significant period of time. Existing PASS systems have many problems, however. First, PASS housing is typically constructed of materials which fail at relatively low temperatures. Current PASS devices fail after five minutes at 500° F. Accordingly, the system is unable to withstand temperatures even half of flash-over temperatures. Additionally, current PASS systems monitor only movement and do not monitor the vital signs of the fire fighter. Since physiological stress is the primary cause of fire fighter death in a fire situation, the ability to monitor an individual fire fighter's vital signs is imperative. Also, existing PASS systems do not have a heads-up display interface, which conveys information without distracting the fire fighter from his primary duty by displaying information clearly within the line of sight of the fire fighter. Current PASS systems send a signal only to a command center central display, and are also not capable of communicating directly with an adjacent fire fighter or members of the fire response team. Accordingly, because the communication of an emergency must pass first through command and then back to the crew on the scene, valuable time which could be better used to rescue the fire fighter in trouble may be wasted in relaying communications from command to crew. Current PASS systems also only monitor the temperature from a single point on a scale of zero to 350° F., thus neglecting to monitor the upper and lower extremities and the torso for hot spots.

The present invention overcomes the above-described deficiencies by providing an intelligent, integrated facility and fireground management system which is efficient, assures first responder, pedestrian and barrier safety, and precise performance in extreme emergency situations, regulatory compliance, easy and flexible integration with building systems and add-on components, as well as advanced internal component monitoring and event logging. In general the novel benefits of the present invention include: a Universal Facility Controller, designed to control any type of appliance, barrier or barrier system; increased safety to users because appliance malfunctions are minimized; built-in diagnostics which creates offsite appliance monitoring capability; remote troubleshooting enabling a clearer understanding and identification of potential appliance problems, and more efficient service and maintenance; standardized computer controls; software providing for real time monitoring and continuous validation of the facility system; and programmable appliance functions for added safety and security.

Additionally, the system of the present invention provides both real-time first responder situational awareness (RT-FS-SA), and real-time fireground situational awareness by utilizing thermally fortified passive and active sensor and monitoring devices capable of transmitting and receiving real-time data, in extreme temperature conditions, to support first responder decision making.

SUMMARY OF THE INVENTION

The present invention provides a highly scalable smart-sensor facility and fireground management system designed to prioritize pedestrian safety while managing conflicting priorities of appliance control with robust diagnostics and field reconfigurable functionality. The invention is designed to provide up-to-the minute information for first responders, reliable verifiable high level of barrier management security, with, for example, integrated infant-abduction protection, geriatric-patient wander monitoring and visitor access management provisions, smoke compartmentalization and fire-barrier integrity, while adhering strictly to life-safety and other mandated compliance guidelines.

Some of the technical benefits of the present invention include: an integrated library of inputs/components (including physical and virtual components) which can be easily mapped via software to device terminals; resource validation and component monitoring; continuous resource verification with component failure indicator, and field-configurable logic controller with flexible programming options to accommodate multiple requirements, as well as permanent safety and compliance logic features that can not be disabled in the field; diagnostic and simulation functionality for ease of performance testing, troubleshooting and service; searchable disk logging (events created 50 times per second); and innovative logic structure (based on continuous switch monitoring) that assures correct operation of components under all conditions.

In another aspect, the present invention provides intelligent interpretation of a set of input signals. In one embodiment, the system accepts inputs that determine, for example, sensor state, barrier position, ambient temperature, electrical voltage and electrical current. In another embodiment of the invention, the system is capable of monitoring and recording events and ambient states of the facility including, for example, air flow/quality, humidity, occupancy, and hazardous substances including gases, biochemical's, chemicals, and radioactive substances. The sensors of the present invention can be self-configuring and self calibrating. In still another embodiment, the system of the present invention monitors and records the function or non-function of various system sensors.

In a further embodiment, the system of the present invention validates the correct operation of output devices such as motors and alarms, as well as providing automated fault detection and diagnostics, performance monitoring, and advanced commissioning. The system of the present invention provides a human-control system interface. In an additional embodiment, the system of the present invention provides audio messages as well as audio and visual alarms to pedestrians to advise the pedestrian of impending system actions, and current alarms.

In another aspect of the invention, a calendar processor is provided for the purpose of accommodating special requirements of a particular type of pedestrian, such as for example, persons prohibited by religious observance from activating electrical devices on Sabbath occasions. In one embodiment, the microcontroller of the system allows access to system data by a remote intelligence such as a central processor. This is typically for the communication of information to building management systems and security instances. In still another embodiment, the facility and fireground management system of the present invention provides information to system inspection and maintenance personnel to allow for efficient diagnostic maintenance repair.

Additional aspects of the present invention will be apparent in view of the description which follows.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

FIGS. 13A and 13B show representative 3D screen images of the system's presentation of a managed facility in accordance with one embodiment of the present invention.

FIGS. 14A and 14B illustrate the door mode priority conflict management design criteria in accordance with one embodiment of the present invention.

DETAILED DESCRIPTION OF THE INVENTION

Figure 1:
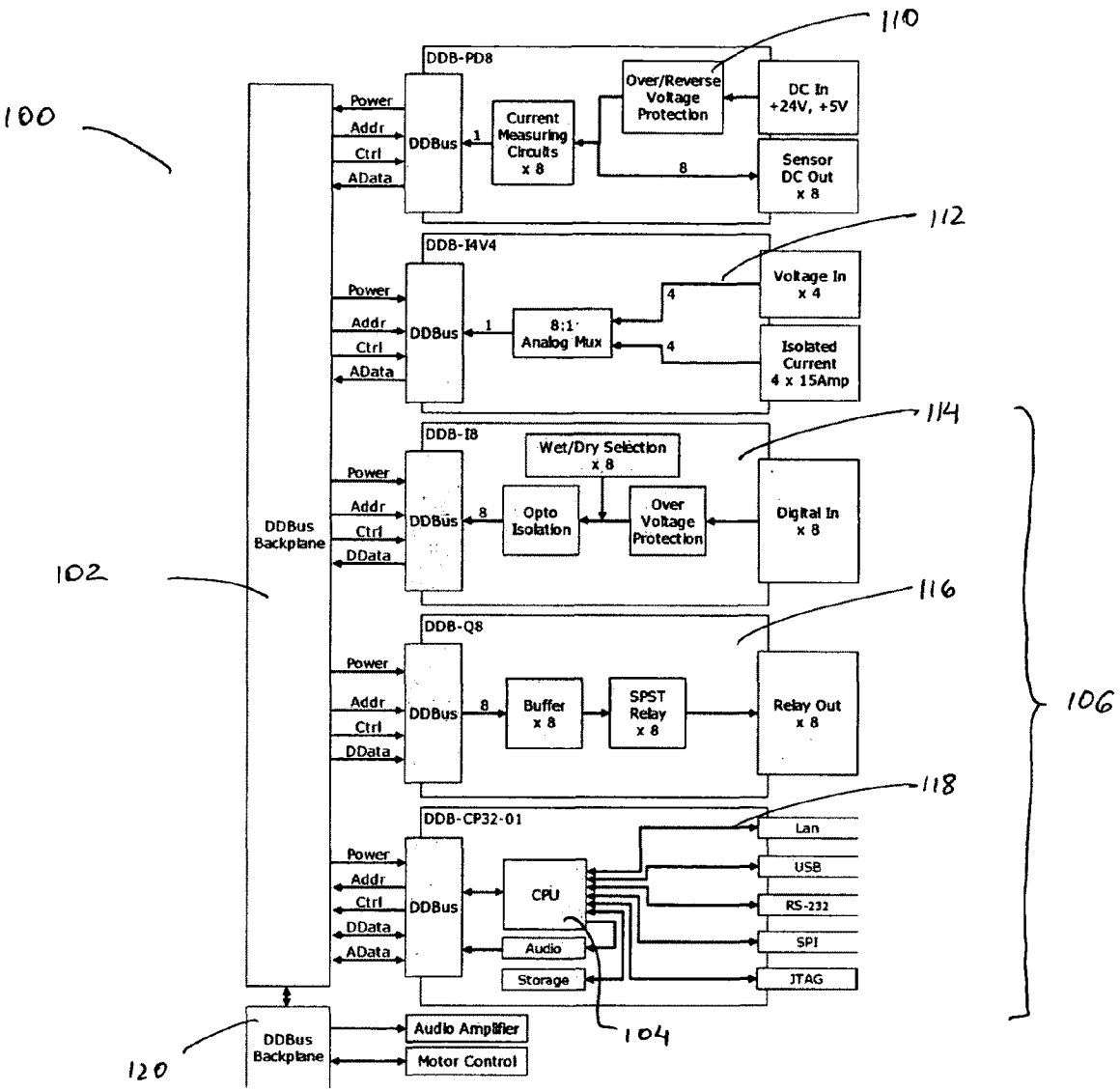
FIG. 1 is a schematic illustrating the hardware component arrangement of the facility management device in accordance with one embodiment of the present invention.

Embodiments of the present invention are described herein in the context of a method, system and apparatus for providing an intelligent, integrated facility and fireground management system. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with the present invention, the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Erasable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card and paper tape, and the like) and other known types of program memory.

The present invention provides an intelligent, integrated facility and fireground management system which is efficient, assures human and appliance safety and precise performance in emergency situations, regulatory compliance, easy and flexible integration with building systems and add-on components, as well as advanced internal component monitoring and event logging.

In a specific aspect, the present invention provides a facility and fireground management system comprising a structure; one or more barriers coupled to the structure, wherein each barrier is capable of being open or closed in response to a corresponding control signal; one or more sensing devices coupled to each barrier and configured to obtain ambient information relating to each barrier; one or more controllers coupled to each barrier, wherein each controller further includes a local processor configured to provide a control signal to a corresponding barrier; a communication device coupled to the local processor and configured to provide communications between the local processor and one or more sensing devices; and a local storage device coupled to the local processor and configured to store at least a portion of history logging, terminal services, calendar service and ambient information relating to the corresponding barrier. "Facility" as used herein refers to any entity including, a building, a campus, a city or larger entity. "Barrier" as used herein refers to any physical object that obstructs, defines or encloses a space and includes, but is not limited to, walls, partitions, containers, vessels, doors, a windows, gates, and fences. The entity, facility or structure managed by the present invention can include, by way of non-limiting example, a campus, a city or larger entity, any enclosure, building, ship, aircraft, train, automobile or other vehicle or vessel.

In a specific embodiment, a host computer is coupled to each controller via each communication device and configured to control each controller. In another embodiment, each sensing device and each controller is thermally fortified to function within a temperature range from about −40 degrees Fahrenheit to about 2000 degrees Fahrenheit. In another embodiment, each sensing device further comprises one or more status sensors for detecting status of the corresponding barrier. In another particular embodiment, each sensing device comprises one or more temperature sensors for detecting the ambient temperature of the corresponding barrier.

In one embodiment, the sensing device is a thermally fortified expendable sensing device which can be temporarily placed anywhere within the facility or fireground.

In still another embodiment, each sensing device comprises one or more sensors capable of detecting substances such as, for example, noxious gasses including, but not limited to, carbon monoxide, carbon dioxide, chlorine, cyanogen, flourine, hydrogen cyanide, nitric oxide, nitrogen tetraoxide and phosgene. In another embodiment, each sensing device comprises one or more sensors capable of detecting substances such as, for example, combustible gasses including, but not limited to, oxygen, hydrogen, acetone, acetylene benzene butane butyl alcohol (butanol), diethyl ether, ethane, ethyl alcohol (ethanol), ethylene, ethylene oxide, hexane, isopropyl alcohol (isopropanol), methane, methyl alcohol, methyl ethyl ketone, n-pentane, propane, propylene styrene, toluene, and xylene. In another embodiment, each sensing device comprises one or more sensors capable of detecting toxic gasses as well as oxygen displacing gasses and other gasses hazardous to human health as typically defined by OSHA, or otherwise known by those of skill in the art. An another embodiment, each sensing device comprises one or more sensors capable of detecting dangerous and/or harmful radioactive, chemical or biochemical agents.

In an embodiment, each controller is configured to process a one or more single or grouped Doppler radar signals. In another embodiment, the communication device provides wireless communications between the local processor and the host computer. In another aspect of the invention, the host computer is capable of instructing a local processor to open or close one or more barriers in response to ambient information obtained by a sensing device associated to one or more barriers which are not associated with the local processor.

Figure 13B:
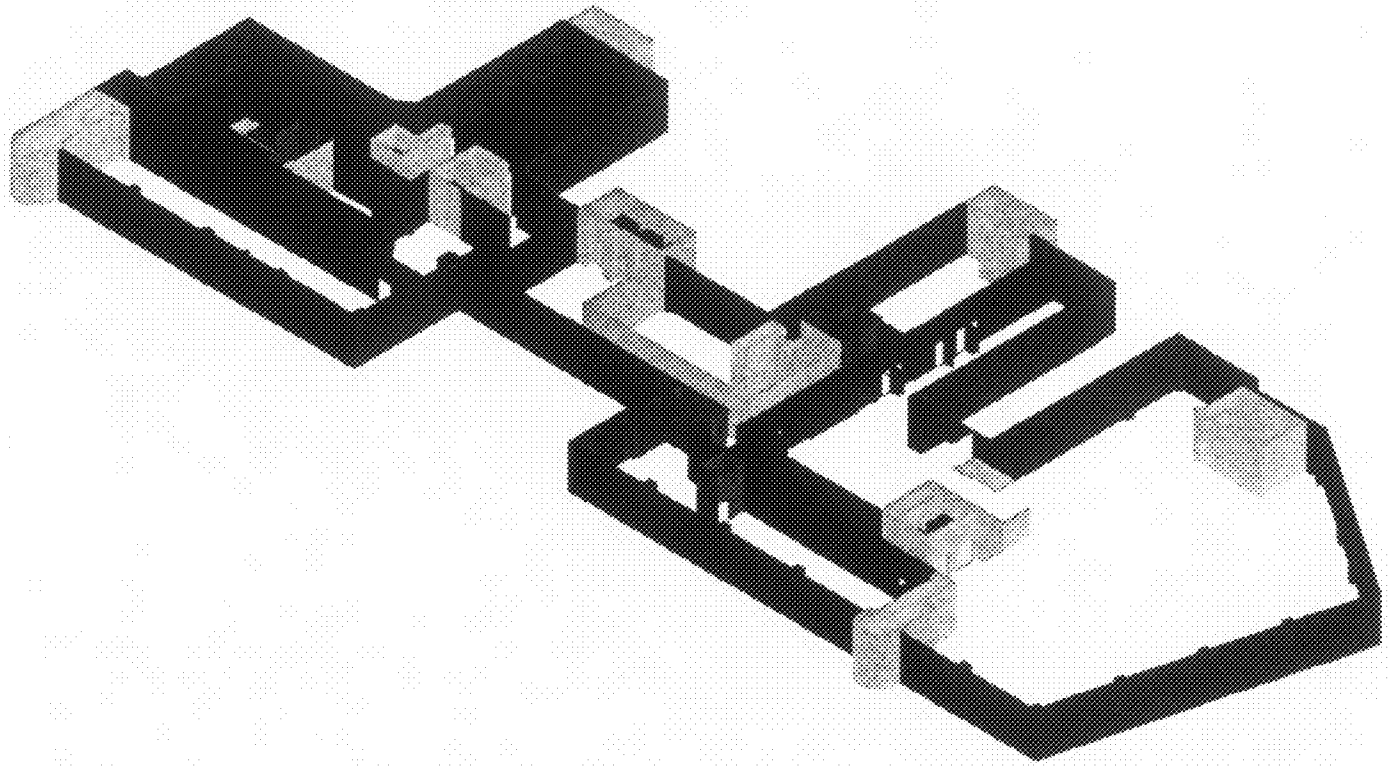

Following the Lessons Learned Information Sharing Protocol, the system is capable of presenting the current global status of the monitored facility in a realistic three dimensional CAD interactive rendering which accurately represents the information in real time in an intuitive manner. FIGS. 13A and 13B depict representative 3D screen images of the system's presentation of a managed facility.

The system of the present invention is also capable of communicating the significance of monitored events to system users in an optimal manner by providing current, historical and anticipated values with design and safety limit parameters for effective comparison. The term system users includes any person using the system such as, for example, facility staff, pedestrians, maintenance workers, and emergency first responders.

The facility and fireground management system of the present invention is also capable of verifying not only whether an alarm condition has been acknowledged but also whether the alarm has been responded to appropriately. The system accomplishes this by incorporating redundant onboard and remote journals of the event and the response requiring the controller state of alarm to remain persistent until both the alarm condition is removed and an acknowledgement by an authorized individual had been appropriately executed in a timely fashion.

By way of non-limiting example, if a system sensor detects a significant event such as water in a stairwell, an alarm will be activated, alerting facility staff to investigate and take remedial action with respect to the source of the alarm. Even if the system sensor no longer detects water, the alarm will persist until the system confirms that an authorized individual has appropriately responded to the alarm. In this instance, the alarm state could only be shut off after the system has detected the RFID of an authorized maintenance employee in the same physical area of the sensor that initiated the alarm. In this way, the system provides assurance that the situation that precipitated the initial alarm has actually been investigated by an authorized individual and responded to appropriately.

The current system is also capable of effectively monitoring system integrity using both wired and wireless communication channels at a consistent interval to serve as a keep alive bi-directional validation and incorporate qualified, encrypted "virtual signature" signals. Specifically, in an embodiment, the system communicates using pulse width modulation (PWM) signals.

The facility and fireground management system of the present invention is also capable of ensuring the reliability of potential alarm condition values by utilizing distributed intelligent data-gathering devices with redundant hierarchal validation of current values to discern potential alarm conditions deriving from a specific input value, an accumulation of input values or the hardware complement itself. In an embodiment, the system is self validating in that 30-50 times per second the system scans and validates that each required hardware component is present and functioning properly, and that no unauthorized hardware is present.

In one embodiment, the system of the present invention uses optimized criteria obtained from consistent evaluation of design parameters against journaled historical data to audit system performance against actual entity energy and usage patterns. Accordingly, the system is capable of calibrating itself to provide the minimal required power to perform a specific job. In one representative example, the system utilizes journaled historical data to determine the minimal amount of power to supply to an automatic door in order to compensate for wind interference with the door.

Figure 18:
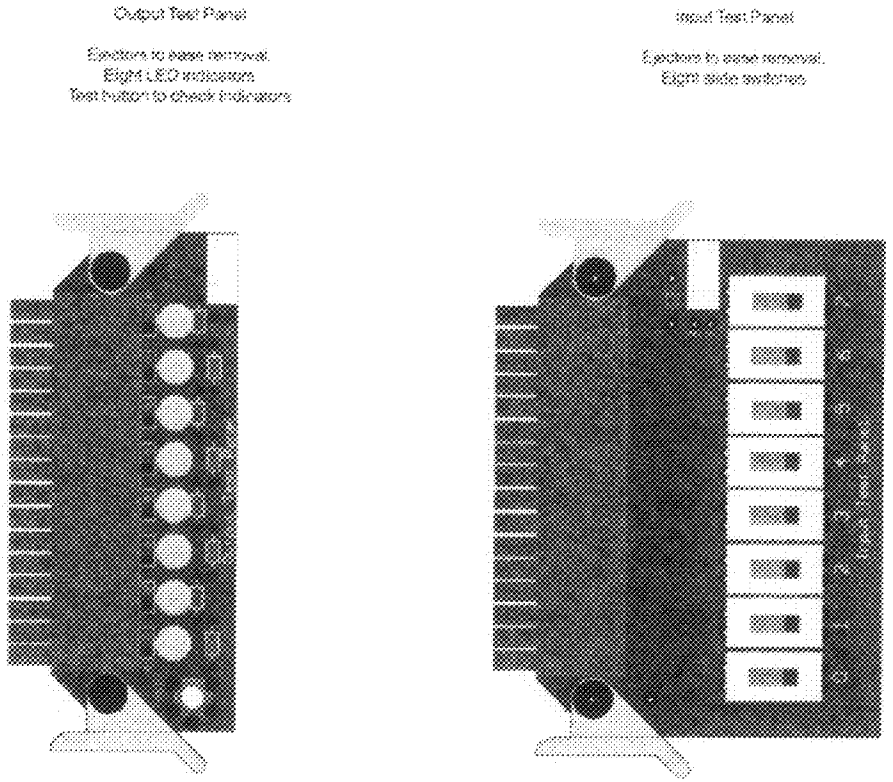
FIG. 18 depicts an output test panel and an input test panel in accordance with one embodiment of the present invention.

The facility and fireground management system of the present invention is also able to prolong the operation of the system as well as the viability of means of pedestrian ingress/egress within the facility when the facility is under duress, (e.g., experiencing an emergency such as or fire, attack) by utilizing robust components with vibration mountings and thermal protection for both system and facility vertical/horizontal thoroughfares. In one embodiment of the invention, the system components are thermally fortified with ZShield™ or an equivalent substance, as described in co-pending U.S. Application Ser. No. 60/851,097, which is incorporated herein in its entirety. The components of the present invention provide universal switchable input output modules with 3.3-440 v ac/dc, and the transient protection meets ANSI C37.90 transient specification. FIG. 18 shows an output test panel and an input test panel in accordance with one embodiment of the present invention.

System assemblies utilized in the present invention are fabricated with industrial grade electrical, electronic and mechanical components which function within a temperature range from at least about −20° C. to +80° C. Thus, the components utilized in the present invention will typically have significantly longer useful lives compared with components that are commercially rated. In a particular embodiment of the present invention, printed circuit board (PCB) assemblies will have a conformal coating applied. Conformal coatings are specially formulated lacquers designed to protect PCBs and related equipment from their environment, thus improving and extending their working life, and ensuring security and reliability of performance. Conformal coatings protect circuitry from hazards including but not limited to damage from chemicals, vibration, moisture, salt spray, humidity and temperature. Component enclosures used in the present invention will also provide overall protection for the assemblies and offer dampening against shock and vibration. In a particular embodiment of the invention, ZShield™ sleeving is applied to one or more enclosures.

The present invention additionally provides a facility and fireground management system comprising a structure; a first barrier coupled to the structure, wherein the first barrier is capable of being opened or closed in response to a corresponding first control signal; a second barrier coupled to the structure, wherein the second barrier is capable of being opened or closed in response to a corresponding a second control signal; a first sensing device coupled to the first barrier and configured to obtain a first ambient information relating to the first barrier; a second sensing device coupled to the second barrier and configured to obtain a second ambient information relating to the second barrier; a first controller coupled to the first barrier and a second controller coupled to the second barrier, wherein the first controller is capable of instructing the first barrier to change from an open position to a closed position in response to the second ambient information while the second controller instructs the second barrier to change from a closed position to an open position.

In one embodiment, the first controller further includes a first local processor configured to provide the first control signal; a first communication device coupled to the first local processor and configured to provide communications between the first local processor and the host computer; and a first local storage device coupled to the first local processor and configured to store at least a portion of history logging, terminal services, calendar service and ambient information relating to the first door.

Methods for managing the barrier system of the present invention are also provided comprising obtaining real time from a real time clock across a network; collecting ambient information associated with a first barrier via a set of sensors; locating calendar data from tables stored in a storage location according to the real time; evaluating ambient information according to standard preloaded information stored in the storage location; recording each event logging according to a predetermined event list; instructing to change the first barrier current position according to the ambient information associated with the first barrier. In one embodiment, the instructing to change the first barrier current position further includes opening the first barrier if the ambient information detects high temperature and one or more pedestrians around the first barrier. In another embodiment, communication between a controller and the local host computer occurs via a wireless communication network.

In still another aspect the invention provides an apparatus or device for barrier management comprising a means for obtaining real time from a real time clock across a network; a means for collecting ambient information associated with a first barrier via a set of sensors; a means for locating calendar data from tables stored in a storage location according to the real time; a means for evaluating ambient information according to standard preloaded information stored in the storage location; a means for recording each event logging according to a predetermined event list; a means for instructing to change the first barrier current position according to the ambient information associated with the first barrier.

Figure 15A:
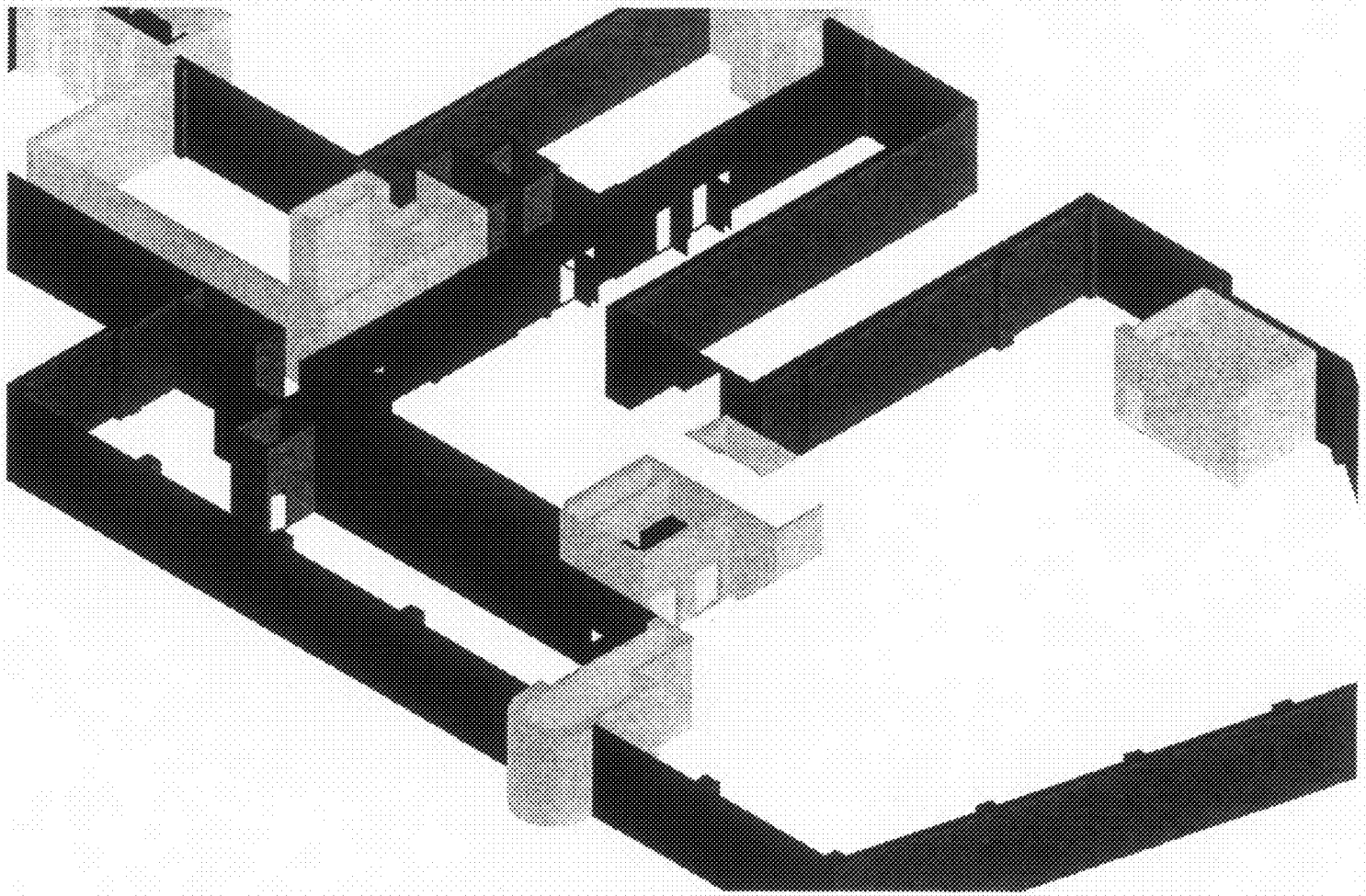
FIG. 15 illustrates the user priority conflict management design criteria in accordance with one embodiment of the present invention.
Figure 16A:
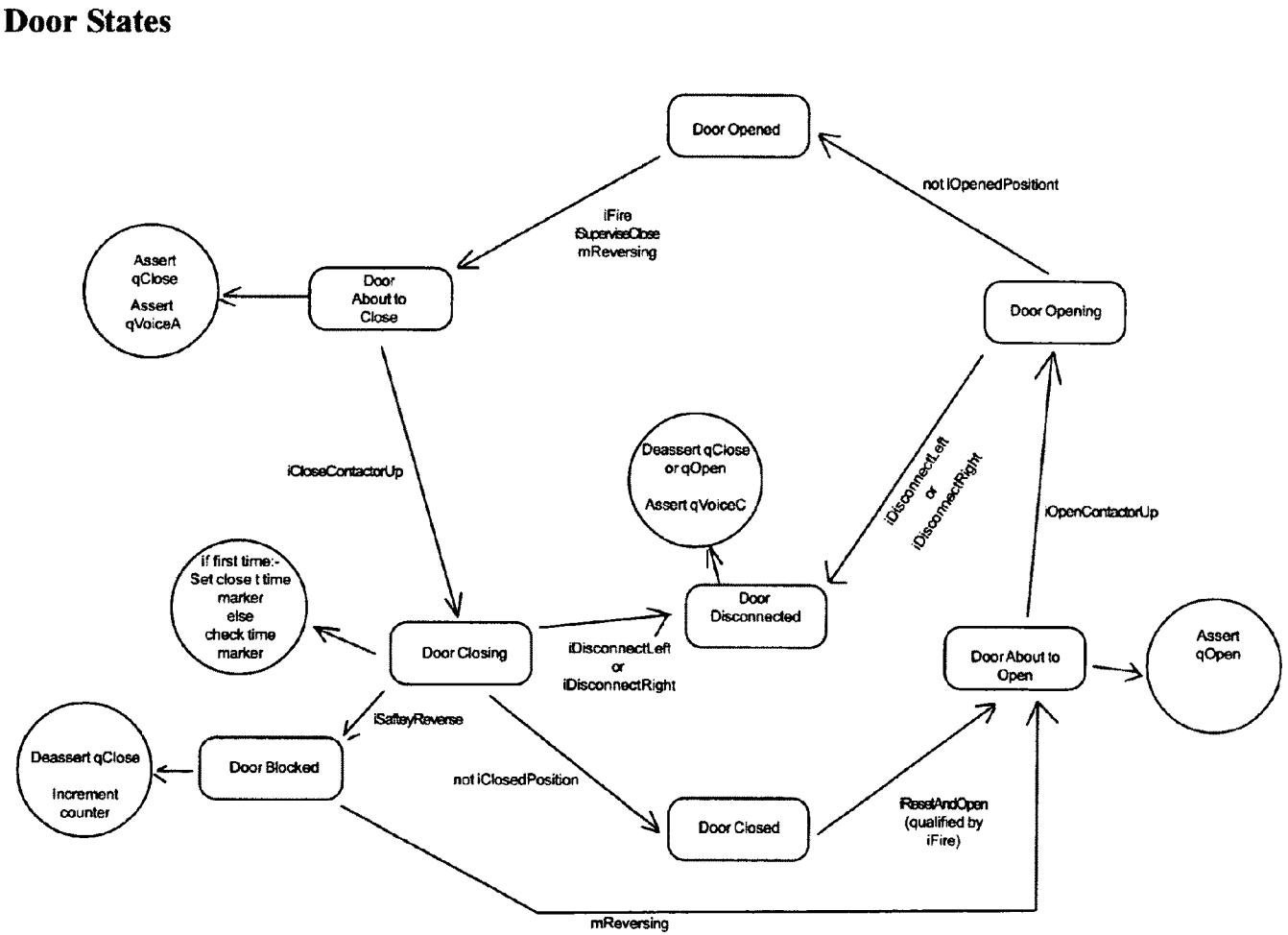
FIG. 16A is a schematic illustrating the door states in accordance with one embodiment of the present invention.
Figure 16B:
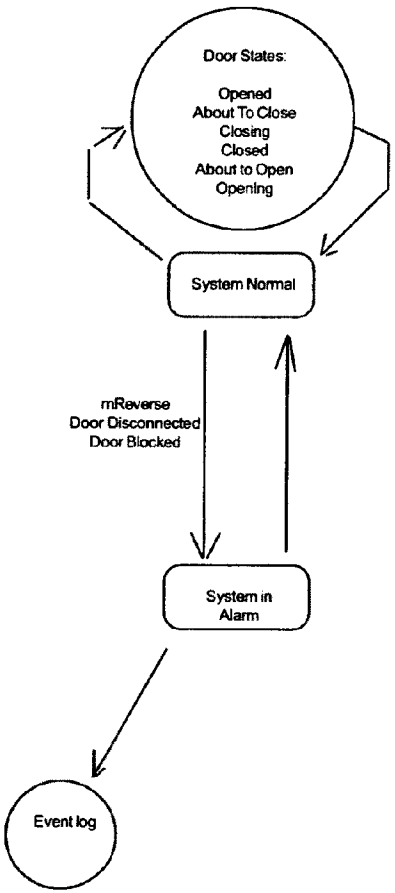
FIG. 16B is a schematic illustrating the system states in accordance with one embodiment of the present invention.

The facility and fireground management system of the present invention provides up to date information for first responders, and a reliable verifiable high level of facility management, security and appliance control. The system efficiently resolves conflicting priorities of barrier and appliance management versus pedestrian access, thereby integrating currently fragmented building and life-safety systems on a daily basis as well as during facility duress including, for example, fire, natural disaster, or attack. FIGS. 14A and 14B illustrate the door mode priority conflict management design criteria in accordance with one embodiment of the present invention. FIG. 15 further illustrates the user priority conflict management design criteria in accordance with one embodiment of the present invention. FIGS. 16A and 16B illustrate the door states and system states, respectively, in accordance with one embodiment of the present invention.

The facility and fireground management system of the present invention comprises a microcontroller based controlling device having two primary constituent parts, hardware and firmware. The hardware reads, prepares and presents real world input information, and sets control states on real world output devices. The hardware also provides a number of internal resources such as storage, date and time facilities, communications channels and sound generation.

The hardware is made up from a series of electronic modules which are linked over an electrical bus structure. The hardware of the present invention implements bus structured architecture which allows adjustable count input and output resources in the form of plug in modules. This architecture offers expandability in that additional modules may be included in the system. The expandable design of the system allows site specific features and capabilities to be efficiently implemented.

In a particular embodiment of the invention, the DDBus backplane is a printed circuit board (PCB) which carries signals between a control processor module and input and output (I/O) modules. The signal set on the DDBus backplane has address, control, data and power. The bus also has analog data which extends the data gathering capability of the system. FIG. 1 depicts the bus structure as well as the modules and their functionality. In an embodiment of the invention, a wireless backplane is provided.

The DDB-PD8 module is designed with overvoltage and reverse voltage protection of the primary DC input voltage. The module not only provides a breakout terminal block for powering sensors, but also has measurement circuits of the current taken by the sensors. Module DDB-14V4 provides voltage and current measurements circuits. Monitoring of currents delivered to local devices such as alarm indicators is also possible.

The DDBus system accommodates multiple DDB-I8 input modules, each module has eight inputs. Overvoltage protection is provided. Switches on the module allow Dry/Wet input selection. Up to four DDB-Qx output modules are possible. These are typically relay modules for switching local loads. Alternate configurations such as high powered relay modules are also available. The processor module controls activity on the DDBus. Onboard resources are Ethernet, USB. RS-232 and SPI communications. Storage for system state logging is provided. Additionally, debug facilities for system firmware troubleshooting is available throughout JTAG interfacing. The DDBus allows the interface with other controller devices. Motor controllers can also be integrated within the system.

Figure 2:
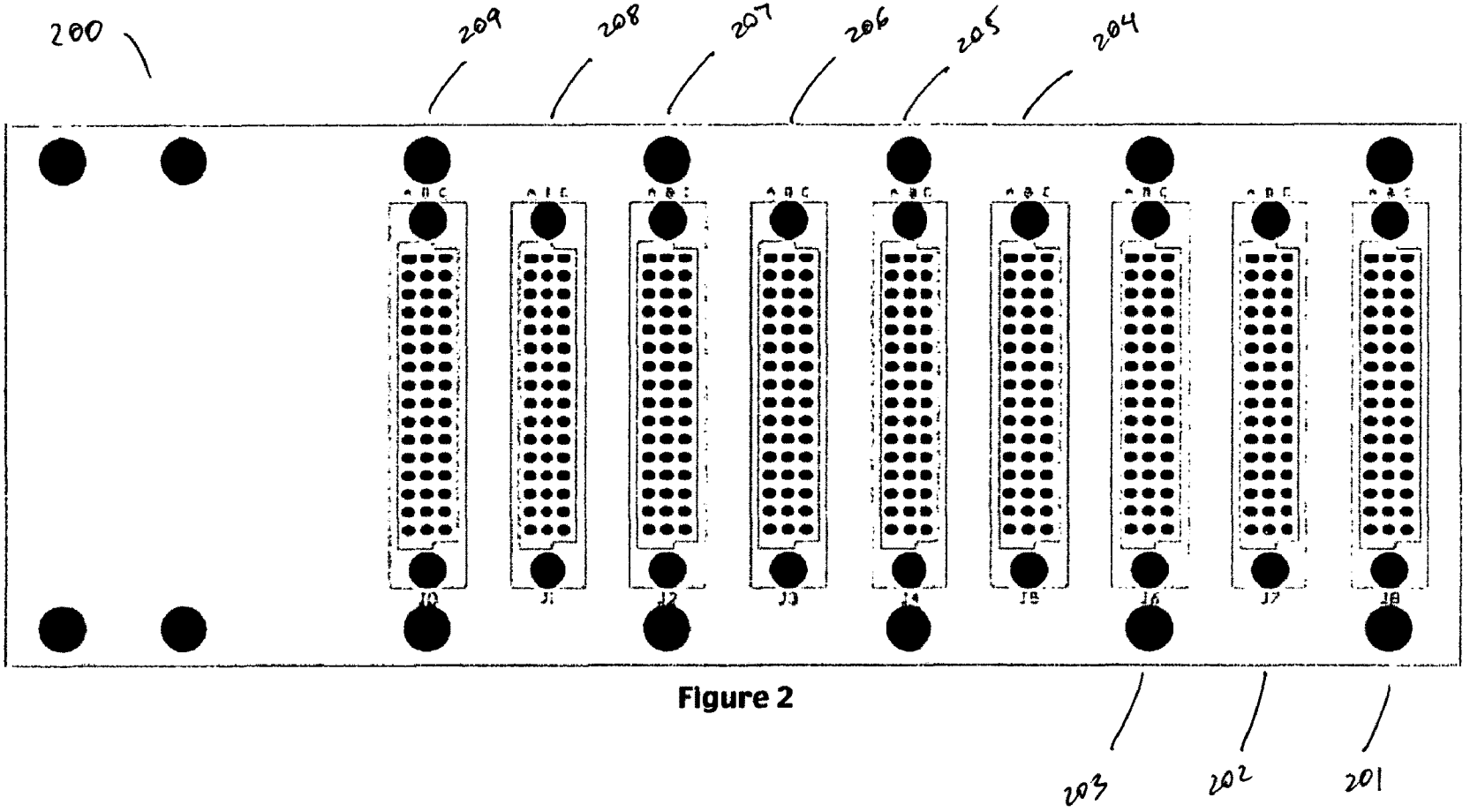
FIG. 2 shows a DDBus backplane in accordance with one embodiment of the present invention.

FIG. 2 shows a DDBus backplane. There are nine slots of which JO as shown on the figure, will attach to the processor module DDB-CP32 to the backplane. The other slots allow up to eight, position independent, I/O cards. It is possible of course, to have backplanes with less or more slots. It is entirely possible to combine backplanes together for expansion purposes. For example a four slot backplane could be the base on which small systems are built and for larger system, an expansion backplane could be added.

The connection arrangement of this new structure is simple bus with 8-bit digital I/O. This allows minimal decoding circuits to be used on the I/O cards. The bus also carries channels of analog inputs which extends the data gathering capability.

Figure 3:
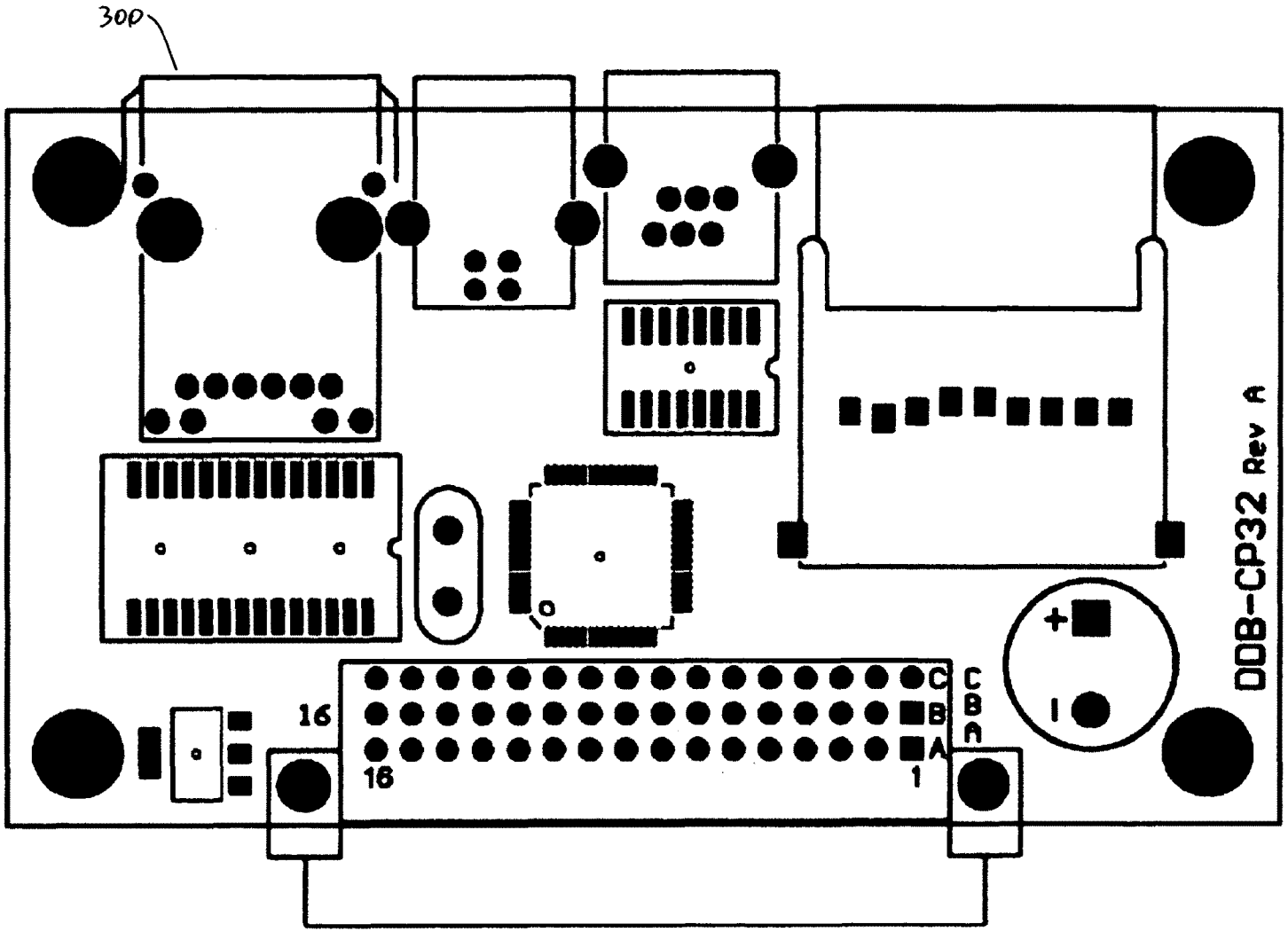
FIG. 3 shows a processor module containing the processing environment for the facility management device in accordance with one embodiment of the present invention.

FIG. 3 depicts a control processor. The DDB-CP32 is a plug in module which contains the processing environment for the barrier management controller. It controls transactions to input/output modules over the DDBus which also plug into the DDBus. The DDB-CP32 has onboard resources for data storage, communications and sound generation. It also has analog signal measurement capabilities.

Figure 4:
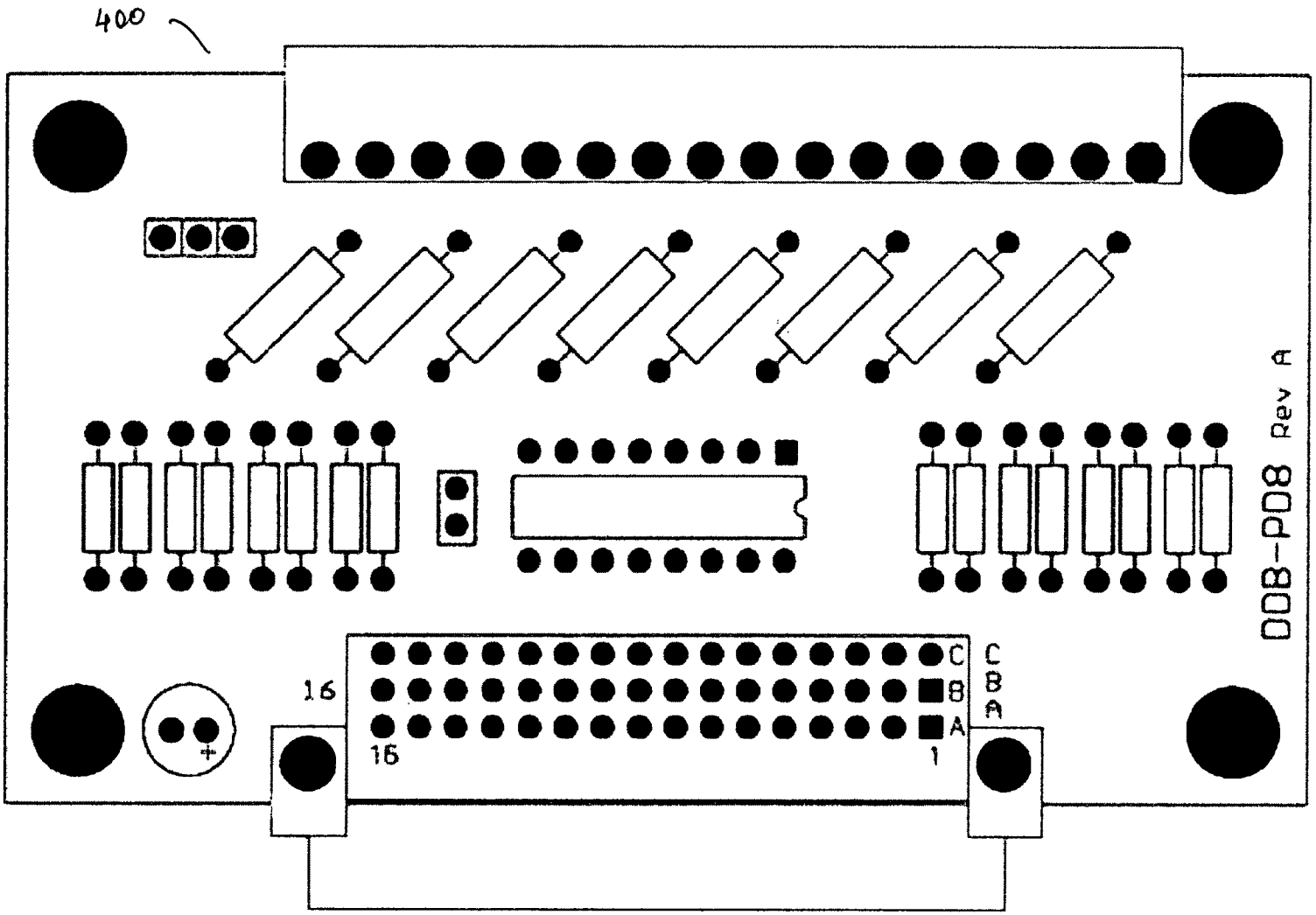
FIG. 4 shows a power distribution and power monitoring module for the facility management device in accordance with one embodiment of the present invention.

FIG. 4 shows a power distribution and power monitoring module. The DDB-PD8 is the power entry point for the system's +24Vdc and the +5Vdc voltage rails. The DDB-PD8 breaks out the +24Vdc to a front edge terminal block for powering sensors. The module incorporates circuitry to allow the processor module to measure the current delivered to each sensor. Having the capability of measuring the current delivered to each sensor allows the system to validate the sensor's operation.

Figure 5:
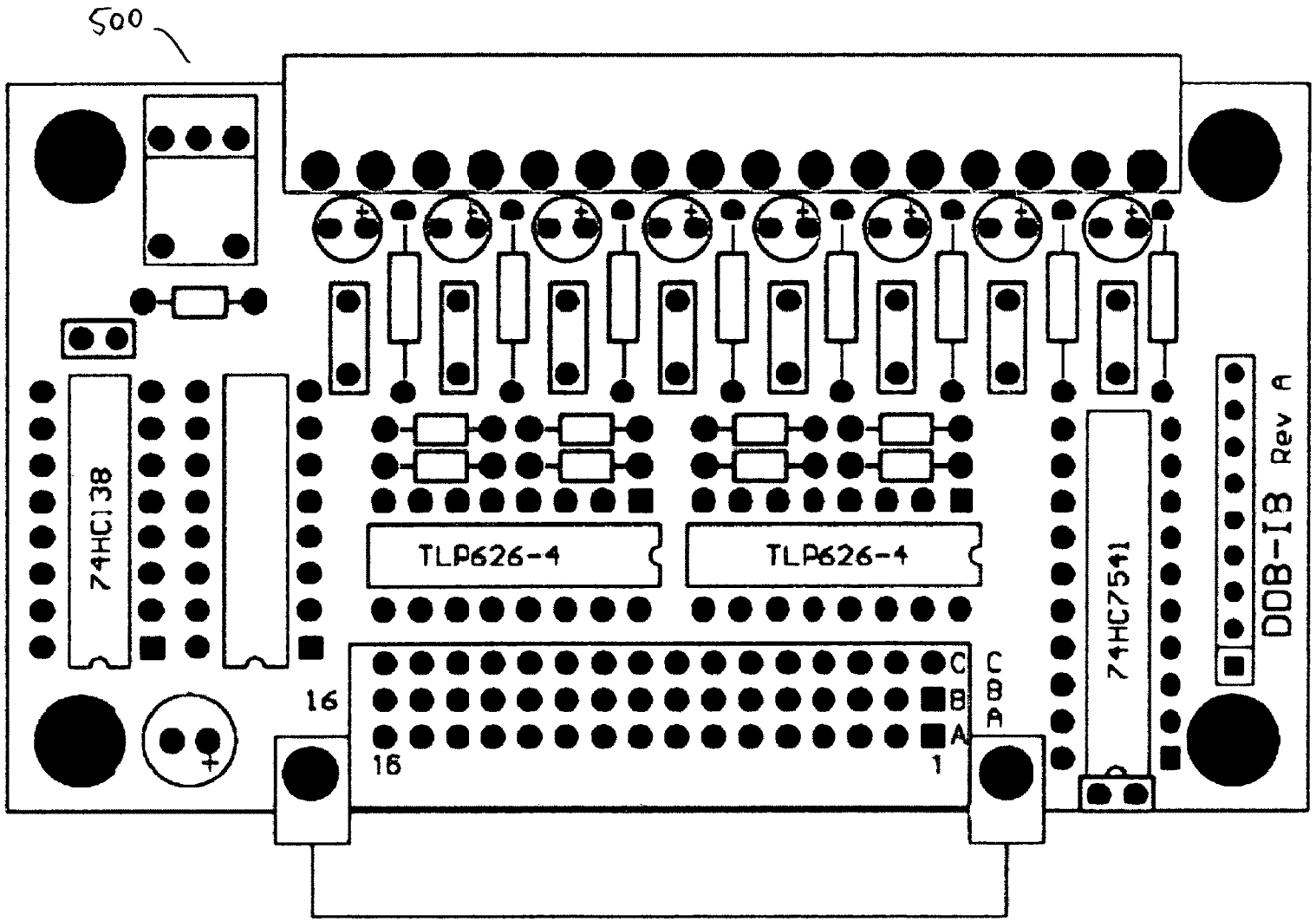
FIG. 5 shows a eight channel digital input module for the facility management device in accordance with one embodiment of the present invention.

FIG. 5 shows a digital input module. The DDB-18 has 8 opto-isolated inputs. Each input channel is selectable for dry or wet inputs. Over/under voltage protection is provided. Multiple input modules may exist within a system.

Figure 6:
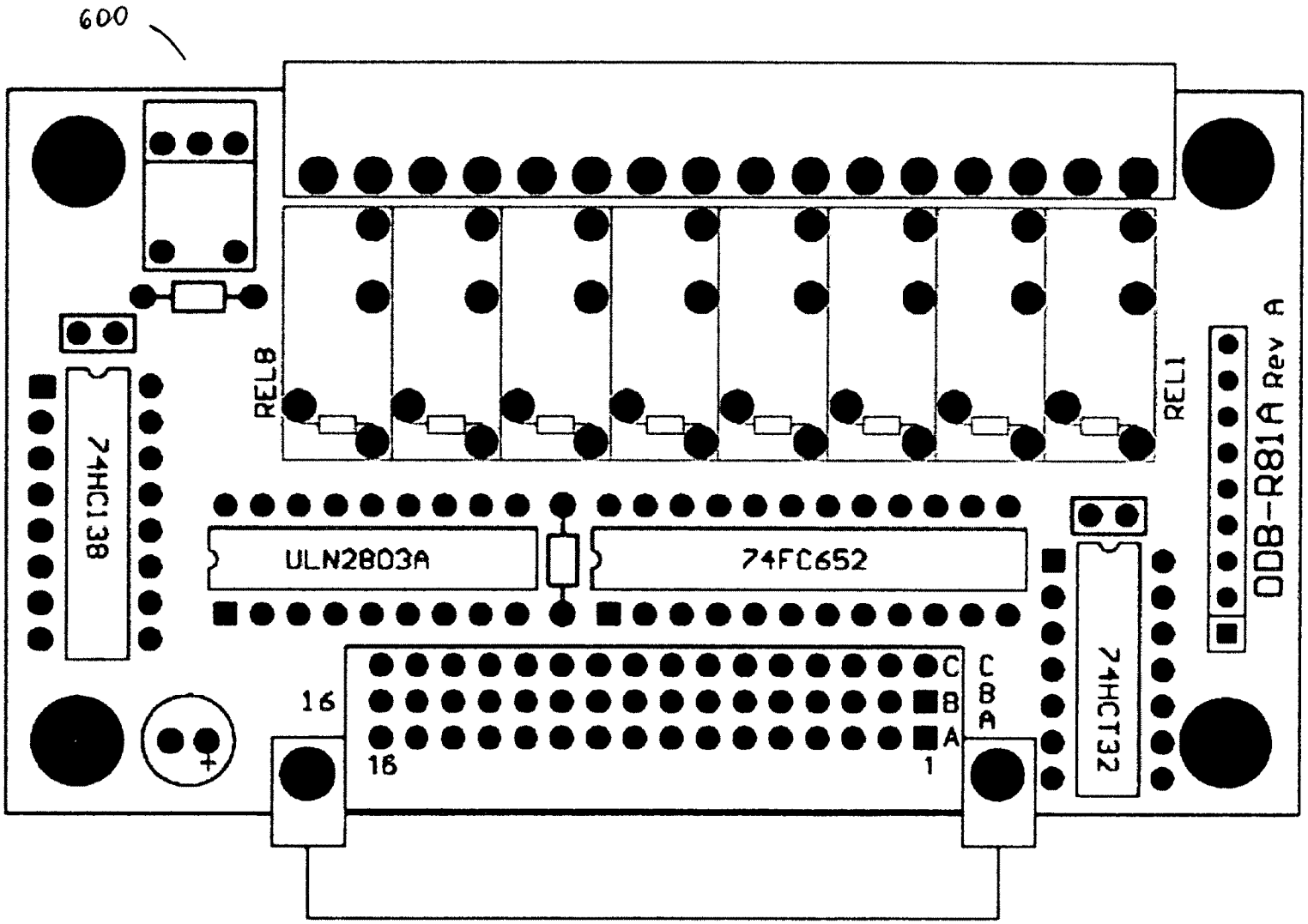
FIG. 6 shows an eight channel digital output module for the facility management device in accordance with one embodiment of the present invention.

FIG. 6 shows a an eight channel digital output module. The DDB-Q8 provides eight digital switches for applying electrical power to output devices. Typical output devices can be solenoids, motors and alarms. Multiple output modules may exist within a system. Output modules with alternate arrangements to suit different circumstances are possible.

Figure 7:
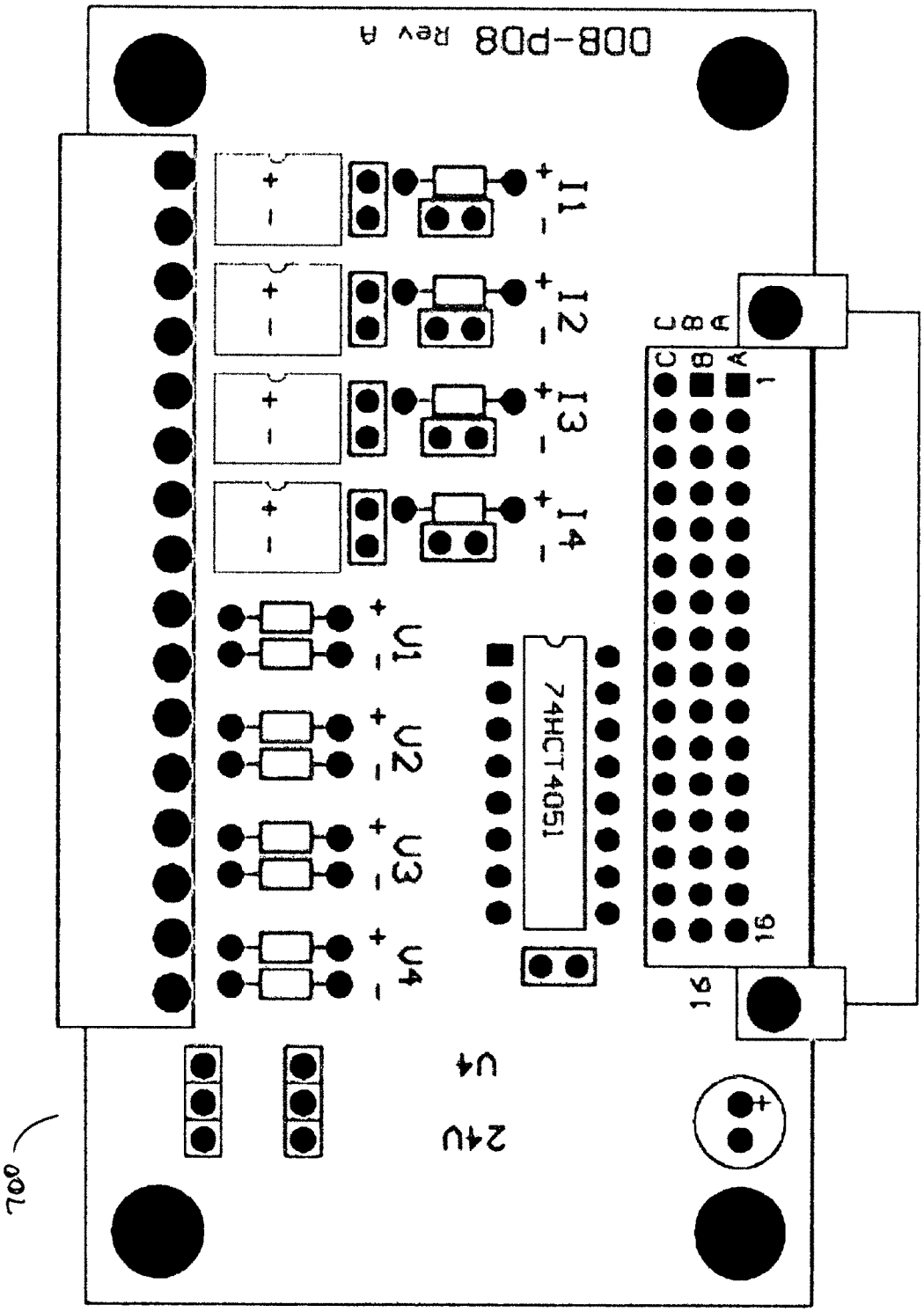
FIG. 7 shows an analog measurement module for the facility management device in accordance with one embodiment of the present invention.
Figure 8:
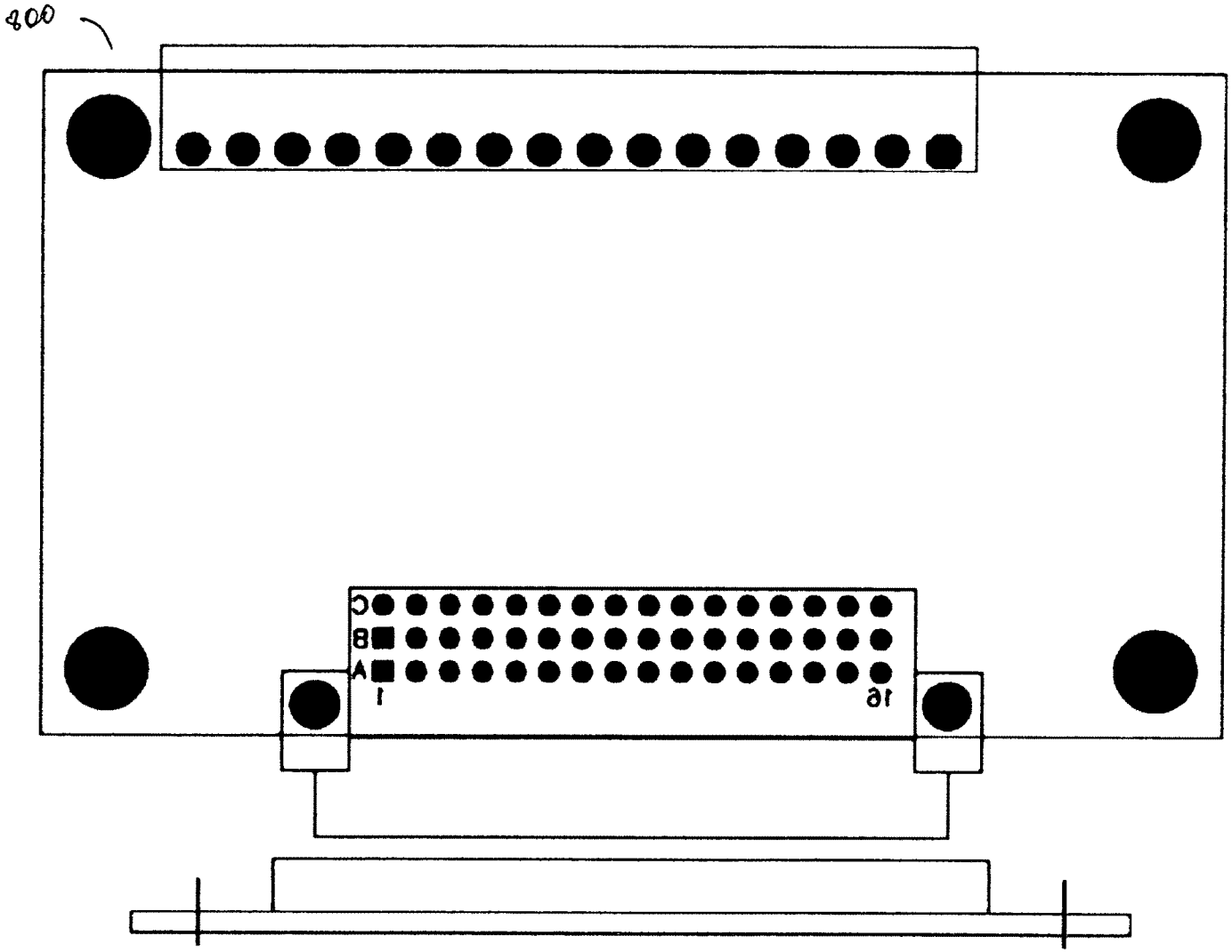
FIG. 8 shows an end view of a DDBus module mounted on a DDBus backplane in accordance with one embodiment of the present invention.
Figure 9:
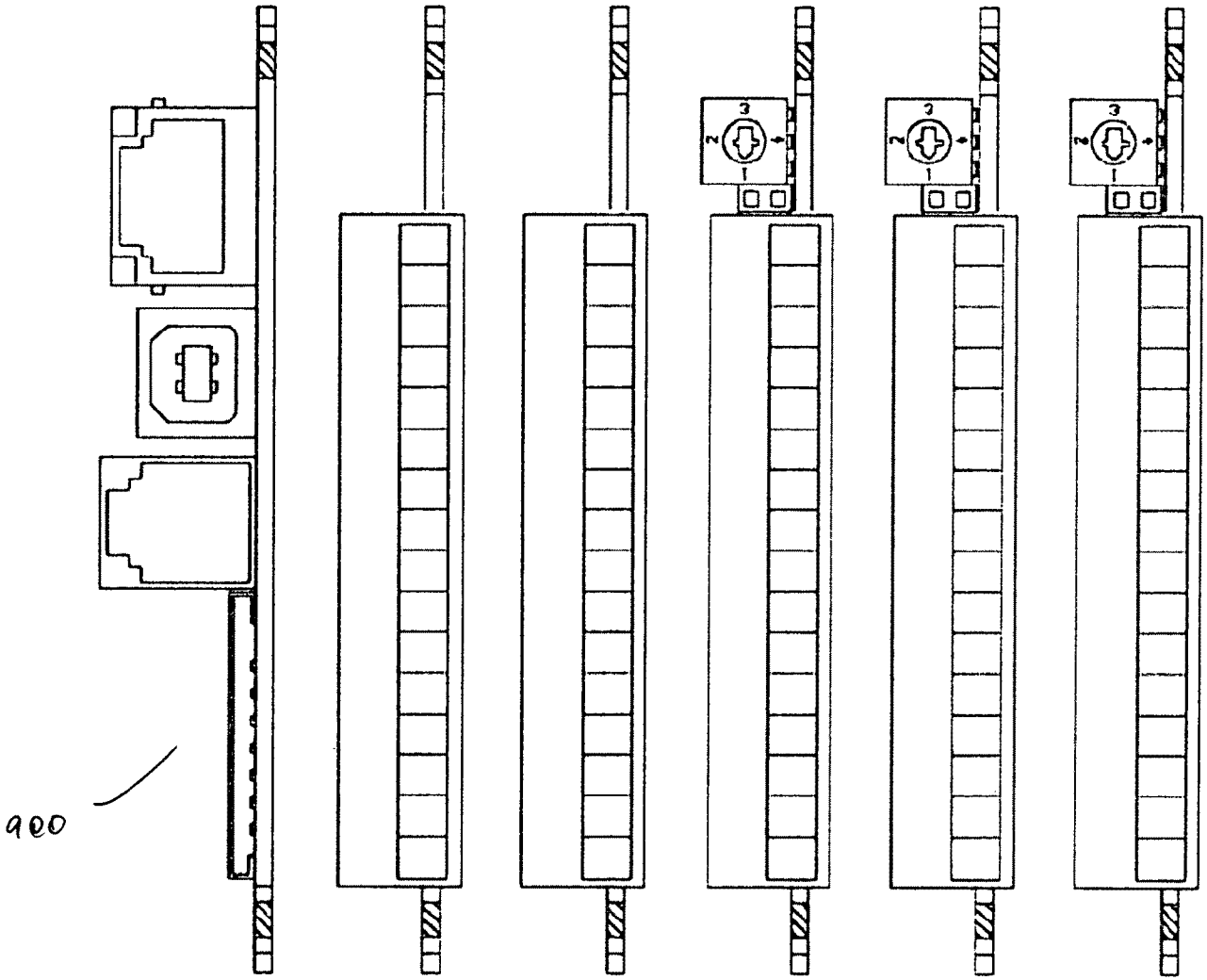
FIG. 9 shows a basic system consisting of, from left to right, a processor (DDB-CP32), power distribution (DDB-PD8), measurement module (DDB-I4V4, and a mix of input and output modules in accordance with one embodiment of the present invention.

FIG. 7 illustrates an analog measurement module for the facility and fireground management system of the present invention. Module DDB-14V4's circuitry is designed for the measurement of four voltages and four currents. Monitoring and validation of an output device's operation is possible with the DBB-14V4. Modules with different mix of voltage and current measurements are possible. FIG. 8 shows an end view of a DDBus module mounted on a DDBus backplane, and FIG. 9 shows a basic system consisting of (left to right) processor DDB-CP32, power distribution DDB-PDB, measurement module DDB-14V4 and a mix of input and output modules.

The present invention includes various processing steps, which will be described below. The steps of the present invention may be embodied in machine or computer executable instructions. The instructions can be used to cause a general purpose or special purpose system, which is programmed with the instructions to perform the steps of the present invention. Alternatively, the steps of the present invention may be performed by specific hardware components that contain hard-wired logic for performing the steps, or by any combination of programmed computer components and custom hardware components. While embodiments of the present invention will be described with reference to the Internet, the method and apparatus described herein is equally applicable to other network infrastructures or other data communications environments.

A particular advantage of the present invention specific to barrier management includes an Absolute Encoder which discerns the exact position of door leaves/panels in space, independent of motor/operator function. The encoder can be set to about 1/10 of a millimeter gradation. In another embodiment, the barrier management device comprises a four-quad regenerative motor control (a customized universal AC/DC 24 volt to 220 volt 3-phase motor controller made of high-performance sub-components).

Figure 17:
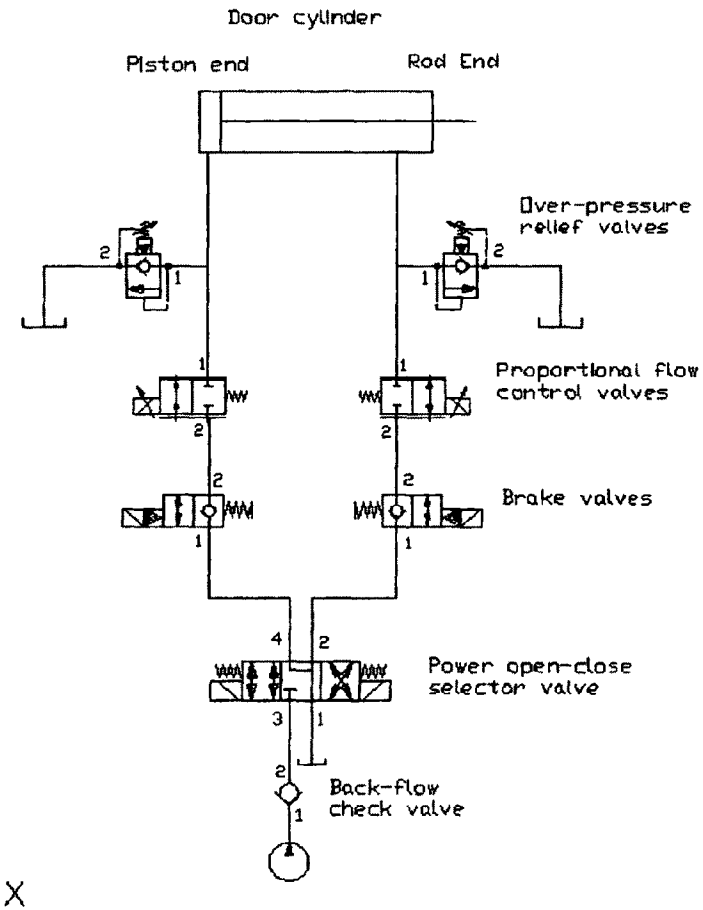
FIG. 17 is a schematic illustrating the hydraulic circuit of the hydraulic device in accordance with one embodiment of the present invention.

In one embodiment, the system uses a hydraulic device (Hydrologic system) comprising a hydraulic cylinder allowing the door to open 110 degrees; hydraulic hoses to extend to a remote location control box; a hydraulic pump; multi-valve/venturi electrical mechanical hydraulic control; and a sealed hydraulic reservoir. In one embodiment, the hydraulic device use a liquid-based system with a regenerative reservoir and a standby supply tank, as well as an optional mini-pump to compensate for door size and other variable field conditions. The hydraulic device's provides the capability for highly flexible speed adjustment along the door's length of travel. FIG. 17 illustrates the hydraulic circuit of the hydraulic device of an embodiment of the present invention. In the event of a power failure to the system, or upon receipt of mechanical override, the system shall default to a manual operator with 8 lbs of closing force. In an additional embodiment, the closing force can be modified to meet ADA or other applicable standards.

The Firmware of the present invention relates to the activity of processing the information gathered from the hardware and applying decision making algorithms for the purpose of deriving a set of output states and output conditions. Although the firmware is written in the C programming language, the skilled artisan will recognize that other embodiments of the invention could be implemented with alternate computer programming languages. The firmware can be changed or rearranged to accommodate the adoption of new hardware.

Figure 12:
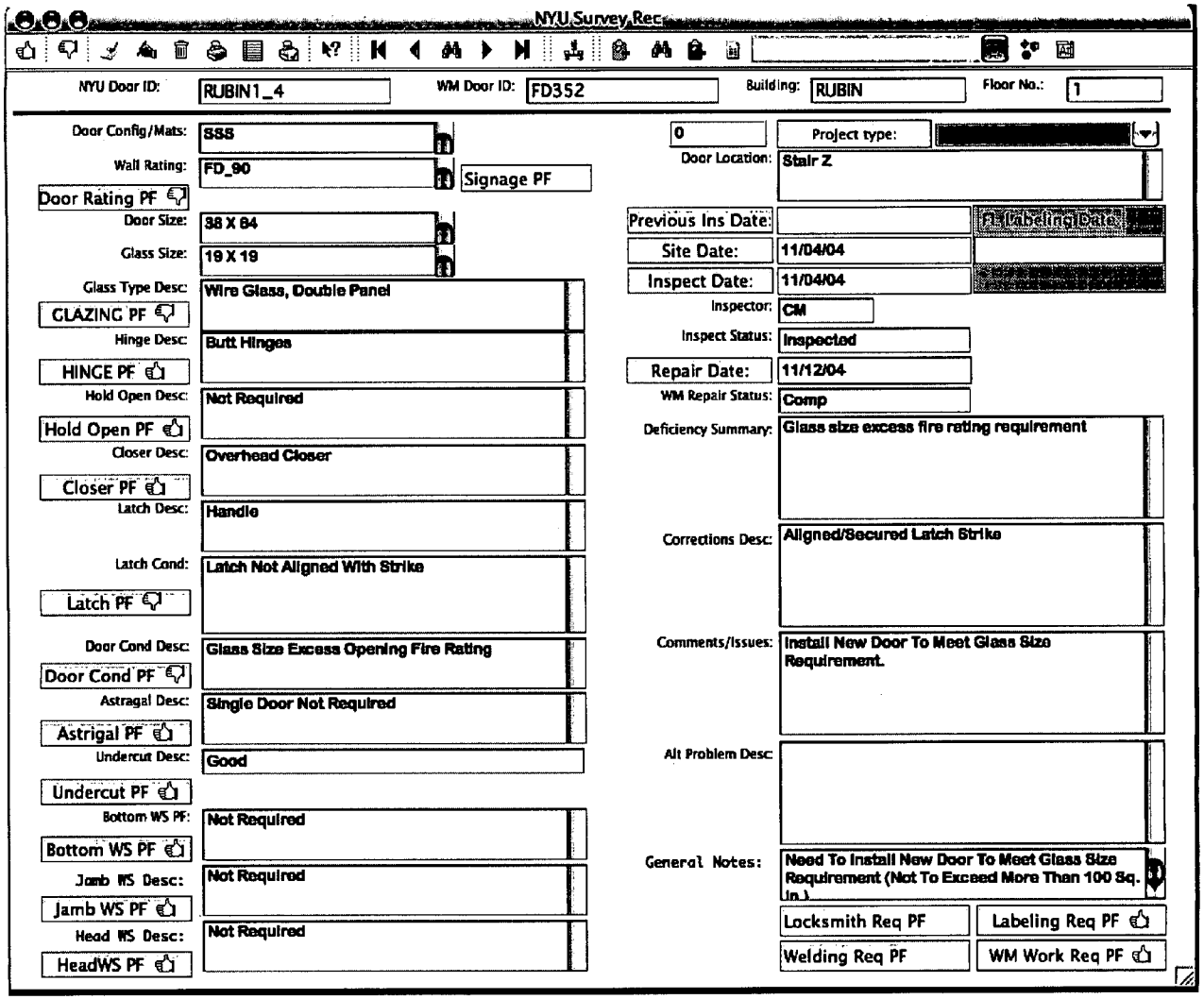
FIG. 12 depicts a representative screen image of the functioning FacilitySoft installation software of the invention in accordance with one embodiment of the present invention.

In one particular aspect of the invention, the firmware is designed to be "cover all", that is, the firmware is capable of controlling different types of appliance installations depending on the particular facility or site and the specific regulations governing particular appliances or barriers at such a facility or site. A configuration process which is conducted during installation, determines which control algorithm is to be executed. The firmware is fully capable of controlling installations subject to applicable regulations of, for example, the National Fire Protection Agency (NFPA), American National Standards Institute (ANSI), Americans with Disabilities Act Accessibility Guidelines for Buildings and Facilities (ADAAG), Building Officials and Code Administrators (BOCA), Southern Building Code (SBC), International Building Code (IBC), Centers for Medicare and Medicaid Services (CMS), Joint Commission on Accreditation of Healthcare Organizations (JCAHO), United States Access Board, American Association of Automatic Door Manufactures (AAADM), Department of Homeland Security (DHS), Emergency Management and Response Information Sharing and Analysis Center (FEMA's EMRISAC), as well as various state departments of health and other state agencies. FIG. 12 depicts a screen capture of the functioning FacilitySoft installation software of the invention.

The system of the present invention utilizes a suite of software tools (FacilitySoft) in the management of and communication with a controller. Connection to a controller is conducted over a secure communications channel which may only be established by an authorized, and suitably identified, operator. Software tools from the FacilitySoft suite which are available to the operator will be based on the operator type. Installation personnel for example, will access the Signal Set Verification tool to check each input's and each output's wiring and operability of an offline controller. Maintenance operators will have access to the controller's diagnostic and test tools for online verification of the controller's performance. Commissioning operators will, in addition to the above toolsets, will be able to access the controller's configuration data set for review and/or modification. Client administrative staff are recognized for access to the journal. Government inspector or an client auditor, will have searchable access to the controller's journal for extraction of reports. Typically this would be for the extraction of reports of system inspections. An emergency and/or event responder will need to access the controller for the acknowledgment of an event/emergency and/or review of real time conditions. Logging (recording) of the operator's identity and session time in provided in the FacilitySoft interface.

Program storage and runtime variables storage for the present invention is within the microcontroller where the program is executed from read only memory (ROM). The firmware of the invention comprises a kernel and a logic solver. The kernel performs housekeeping services and input/output (I/O) services. The logic solver code makes the decisions according to the input states delivered to it by the kernel and sets outputs which are passed to the kernel to action.

Figure 10:
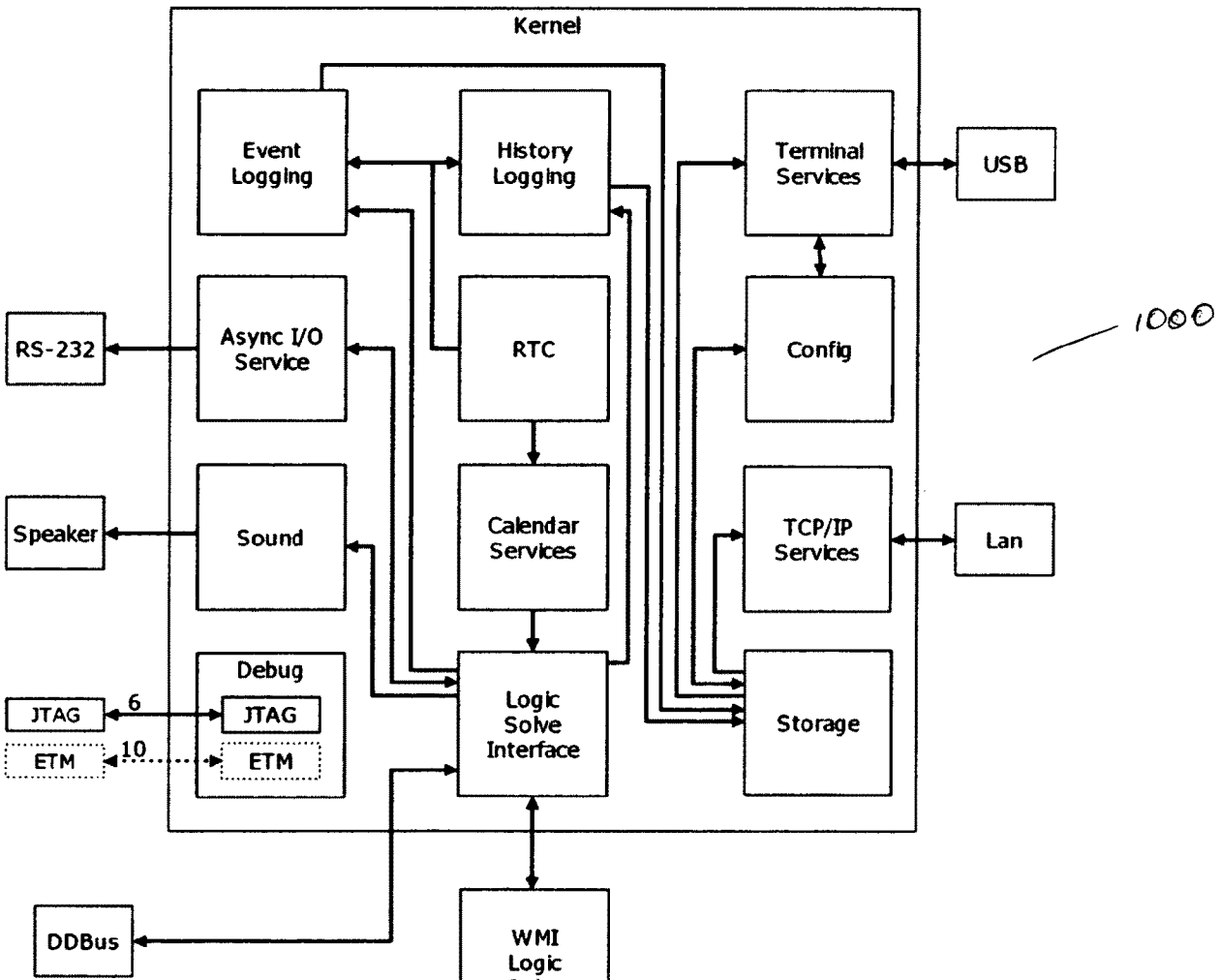
FIG. 10 is a schematic depicting firmware modules and their interaction in accordance with one embodiment of the present invention.
Figure 11:
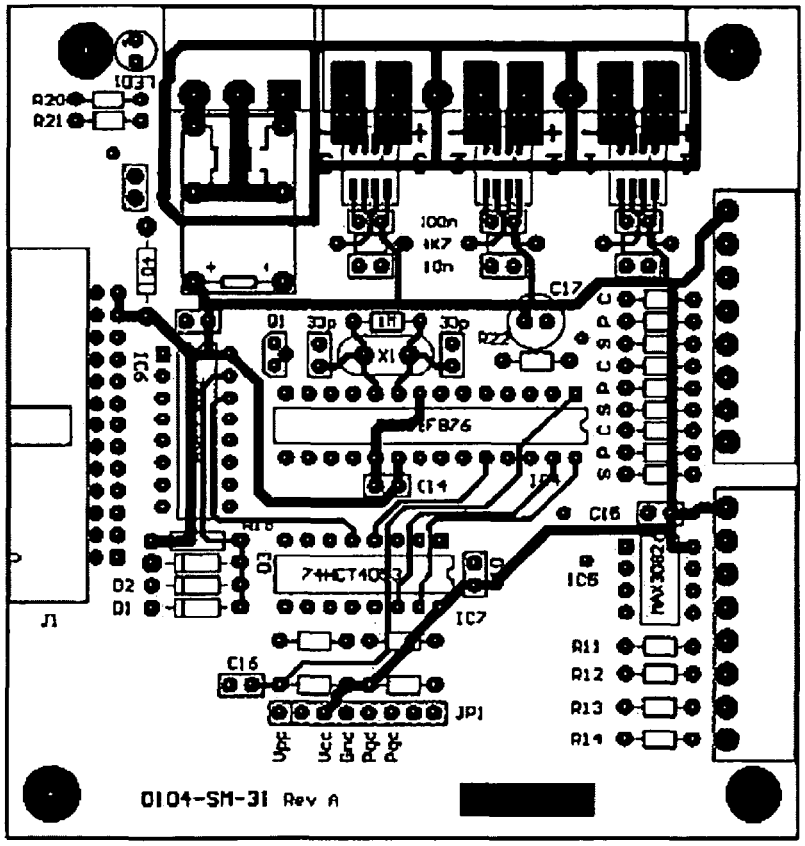
FIG. 11 shows a sensor module for the facility management device in accordance with one embodiment of the present invention.

FIG. 10 depicts the firmware modules and their interaction. The software kernel has a mufti-tasking core which operates a number of services including, but not necessarily limited to: terminal services, configuration data maintenance, real time clock, calendar service, mass storage service, event logging, history logging, Async I/O service, sound generation, internet services, and debug services.

The software kernel of the invention provides a terminal service for the interchange of requests and responses between it and an external communications device. Incoming requests are responded to according to the type of request. The terminal service also provides data uploads and downloads.

Information that is specific to the facility management site is maintained within a data block. The information in this data block is configurable at any point in time through the terminal service. This information is reviewed by the kernel on system startup and actions initialization processes according to the configuration data.

The controller's hardware set includes a clock/calendar facility which includes a battery back-up so that time and date information are maintained if the primary power is removed. The date and time information are used to timestamp logged records. The RTC's date and time are maintained through the terminal service.

The calendar service uses the date and time from the real time clock to determine if the system is within a calendar period. It sets a flag accordingly which is made available to the logic solver. The calendar information consists of a table of pairs of dates and times. One of the pair is the start of the calendar period and the other is the end of the calendar period. The table is held in non-volatile core and can be maintained through the terminal service. A mass storage device is also maintained by the software kernel. It stores and retrieves information as required by the other services.

The event logging service of the invention allows the recording of conditions that are deemed significant. Both the kernel and the logic solver utilize this service. The kernel, for instance, records a system startup as an event. The kernel also records as significant events, any adjustments made to the RTC, the configuration block and the calendar data.

History logging records the raw states of the logic elements associated with the logic solver. These are the physical inputs, the physical outputs, the internal states, timers and counters. At the end of a logic solve, should any change have occurred from the previous solve, a log will occur. Depending on the amount of mass storage implemented, history may be recorded over many months.

The controller utilized in an embodiment of the present invention is capable of communicating by numerous methods ranging from copper wire based RS-485 to sophisticated wireless communications channels. In a particular embodiment of the present invention, the facility and fireground management system comprises a communication "mesh" network in which, for example, one controller/sensor node is able to communicate with any other controller/sensor node (point to point) or to communicate with multiple controller/sensor nodes (broadcast). "Node" as used herein refers to any device connected to a network, such as the communication "mesh" network provided by the present invention. For purposes of the present invention, "nodes" may include without limitation, controllers, fixed sensors, mobile sensors, transceivers, processors and computers.

It will be understood by one of skill in the art that the nodes of the present invention can be passive or active. An example of a passive node is a controller of the present invention, or a fixed sensor. An example of an active node would be a first responder such as a fireman or paramedic who is equipped with a device (e.g., sensor/transceiver) capable of communicating with the facility and fireground management system of the present invention, such as for example, a Fire Team Link™ Real Time Fire Fighter Situational Awareness System. The Fire Team Link™ sensor/transceiver provided by the present invention monitors the internal and external turnout gear temperature at six separate locations on the body of a Fire Fighter: arms, legs, torso, and self-contained breathing apparatus (S.C.B.A). The Fire Team Link™ sensor/transceiver also monitors the fire fighter's vital signs including, but not limited to heartbeat, and respiration, and communicates all of this information wirelessly over the hierarchal mesh network of the present invention. The sensor/transceiver is capable of communicating the x-y-z (physical location) coordinates of a fire fighter in coordination with the fireground reconnaissance system of the present invention.

The Fire Team Link™ sensor/transceiver is also allows full voice communication between the individual fire fighters on the scene and the crew command. In a particular embodiment, the Fire Team Link™ sensor/transceiver is thermally fortified using ZShield™. In another embodiment the sensor/transceiver is configured for contactless recharging.

In one embodiment, the wireless sensor/transceiver is capable of monitoring vital signs of the first responder (e.g. fire fighter) such as temperature, heart rate, respiration, as well as ambient conditions including temperature and presence of dangerous chemical agents, and communicating this information to various nodes throughout the mesh network. In another embodiment, the sensor/transceiver communicates with a device capable of displaying recorded network information on the face plate of a fire fighters helmet ("heads-up display"). In a further embodiment, the sensor/transceivers of the present invention are thermally fortified (e.g., Z-shield fortified) to function within a temperature range from about −40 degrees Fahrenheit to about 2000 degrees Fahrenheit, as described in co-pending U.S. Application Ser. No. 60/851,097, which is incorporated herein in its entirety.

In a specific embodiment of the present invention, the sensor/transceivers comprise expendable sensor/transceivers which can be temporarily placed by first responders at various locations throughout a facility or fireground site. The wireless expendable sensor/transceivers are thermally fortified (e.g., ZShield™ fortified) to function within a temperature range from about −40 degrees Fahrenheit to about 2000 degrees Fahrenheit. In an embodiment, the wireless expendable sensor/transceiver is powered by a rechargeable battery system.

In a particular embodiment, the expendable sensor/transceiver is enclosed in a ZBag™ which consists of a ZShield™-composite jacket with an optional interior "roll-cage" comprising an resilient material such as polymer, or stainless steel. In an embodiment, the ZBag™ comprises a composite layer assembly consisting of a light-weight graphite/ceramic/Kevlar structure, and incorporates intumescent material as described in co-pending U.S. Application Ser. No. 60/851,097, which is incorporated herein in its entirety. In one embodiment, the ZBag™ protects electronic devices from about 30 minutes to about 5 hours, in temperatures ranging from about 1000° F. to about 2000° F. In another embodiment, the ZBag™ is waterproof and dustproof, and resistant to caustic chemicals.

Accordingly, the particular network configuration provided by the present invention allows for a flexible hierarchical organization of data in which one controller or node may assume the role of a "parent" node which overseers the operations of numerous child nodes. The child nodes perform the actual signal input and signal output according to the requirements of the system. A particular parent node can also be managed or controlled by an upper level "grandparent" node, which in turn can be managed by a node higher still in the hierarchy. This node management organization can continue up through the hierarchy to a root node.

Each node of the system is capable of journaling (logging or recording) their operations, cycle by cycle, over many months. Further each node of the system is capable of communicating its particular journal record (log) onto its parent node, which in turn has its own journaling capability. These journals can be sampled at a lower rate.

An important aspect of the intelligent, integrated facility and fireground management system of the present invention is that the devices of the system, e.g., controllers, are capable of self-assessment whereby the state of the facility and fireground management system network is internally analyzed and assessment points or monitoring thresholds, (e.g., flags) are set accordingly. In one embodiment of the present invention, the assessment flags are included in the journal. The present facility and fireground management system is configures such that any node in the system can review any other node's assessment flag(s) and communicate that journal to another node or nodes in the system along with its own assessment flags, which would include all its subservient (child) nodes.

Thus, in accordance with the present invention, a data packet including journaled assessment flags can be communicated throughout the hierarchy level with each node adding its assessment with the destination being the root node. The root node can then decide to communicate directly to the child node to extract information from its stored journal. Since each node has point to point connection, and since each node can assume the role of child, parent or root, the system of the present invention inherently provides hierarchical redundancy of all significant data. Accordingly, the probability of salvaging useful system information is greatly increased in the event that the system sustains catastrophic damage. Any node failing to respond to the communication of an assessment flag can be reported quickly and efficiently to the root node, so that necessary remedial action may be taken.

Each controller of the present invention is autonomous by default, however the system of the invention is designed to adjust and adapt to the operating environment by sharing a pooled knowledge base. For example, if Storage Room A (and its monitoring node) in a facility managed by the present invention is suddenly destroyed, a parent node conducting a routine scheduled scan of its related child nodes will "learn" of the non-existence of the node in storage room A. The parent node then interrogates its related nodes to find which nodes contain the last recorded data package from the Storage Room A node. A redundant node on the west wing on the same floor as the Storage Room A node responds. The interrogating parent node can then request an audit from the redundant node. The audit reveals an unusual rate of rise of oxygen concentration in Storage Room A. Using this information, the system can then apply a revised real-time lessons learned alarm threshold was determined, and, using a validated supervisory control command, broadcast this new alarm threshold to the appropriate controllers throughout the system to be incorporated into the system's logic solve process.

The logic solver is able to generate messages for dispatch through the asynchronous I/O channel. Typically, this is an RS-232 or RS-485 link for delivery to local devices. Alarm messages or informational messages may be dispatched. This service can also receive incoming messages for the logic solver. Additionally, audio messages are able to be delivered to external speakers through the sound service. The logic solver nominates the message to be played.

The hardware set incorporates an Ethernet interface which allows the controller to exist on a network. While the same activity that exists on the terminal service could be conducted through the network, security requirements may dictate that this channel be used only for outgoing informational transactions. Also, in particular embodiments of the invention, hardware resources for level 1 (JTAG) and level 2 (ETM) debug are embedded into the microcontroller core.

In one embodiment, the facility management devices of the present invention are installed using custom-designed color-coded wires and connection terminals and associated instructions. This enhances overall appliance performance for end-users and lower their maintenance time & costs, enable standardized appliance configurations across the facility and make staff training significantly easier (thereby assuring correct performance of routine inspections and appropriate troubleshooting when necessary). This additionally provides a greater degree of confidence in correct installation of the systems by users, while also supporting the ability to produce standardized approaches to installations, service, training, documentation, upgrades and troubleshooting despite varying installation scenarios.

The present invention additionally allows for the creation of an "open system" product which is configured to work with a variety of components, applications, electric and electronic inputs and over-arching information systems. In one embodiment, the facility management devices of the invention are capable of supporting virtually all presently known open protocols and communication standards including, but not necessarily limited to the following: IEC 61131-3 Open programming standard adopted widely for micro PLCs and PAC, the CoDeSys automation alliance; all 750 series I/O modules; industrial asset management control standards such as OPC and HART, protocols that are backward compatible and provide digital communication as well as connection to the 4-20 mA analog signal; SEMI E54 for sensor actuator networks; LonWorks building automation protocol (preliminary EC standard # EN14908); ANSI, NIST, IEEE, CCIA supporting protocols; ELA interface standards (RS-232); PCMCIA memory card standards; XAPIA X.400 standards; W3C and IETF Internet standards; JEDEC IC standards; ETSI European telecom standards; IEC, ISO and ITU International standards; and JEIDA Japanese electronics standards.

The present invention is described in the following Examples, which are set forth to aid in the understanding of the invention, and should not be construed to limit in any way the scope of the invention as defined in the claims which follow thereafter.

EXAMPLES

Example 1

A fire occurs in a 30 year old, recently renovated, high-rise office building (25 stories) where a Fire-ground Communication System in accordance with an embodiment of the present invention has been installed in advance. The fire initiates on the $15^{th}$ floor in an overloaded air conditioner equipment room. The building has 10 elevators and four stair towers. There are four thermally (ZShield™) protected elevators and all of the elevators are configured with the wireless mesh network management technology of the present invention.

Two of the elevators are equipped with elevator cab roof-mounted escape cages as described in co-pending U.S. Application Ser. No. 60/851,139, which is incorporated herein in its entirety. All staircases and elevator lobbies are equipped with the wired and wireless security door control sensing units. Each office suite entrance door and cross-corridor fire door is equipped with a sensor array in accordance with an embodiment of the present invention. Each fire/smoke detector has been upgraded to include the wireless mesh network technology of the present invention. Each elevator lobby, as well each stairway and exit access passageway has been thermally fortified with, by way of example, ZShield™ technology.

Additionally, the building also utilizes the wireless mesh network technology of the present invention to serve as a building-wide HVAC, lighting and security wireless network. Each mesh-network node also serves as a free Radio Frequency Identification (RFID) reader.

The fire department receives the call and responds by dispatching an appropriate number of fire fighters. The building is equipped with the Real Time Fire Ground Situational Awareness (RT-FG-SA) system which electronically transmitted to the fire department's incident command both a standard alarm call and a 3-D image indicating the overall building condition and any potential trouble spots. By pressing the en route icon on their mobile data terminals (MDTs), first responders (fire fighters) are able to receive access to the building's fire alarm to query the conditions of the elevators as well as other life-safety systems. Using the system, the fire fighters are able to determine that the fire was not confined to the room of origin, the adjacent fire doors are not working and the building sprinkler system is not registering adequate water flow.

The first arriving fire fighter company proceeds to the lobby and learns from the real time display unit located there that the elevator shafts are smoke-free and the elevator lobbies are under 100° F. Based upon the wireless data transmitted from the elevator cabs and other components to their MDTs, they learn that neither the elevator or stair systems had been compromised. Two of the thermally fortified elevator cabs are commandeered for fire fighter deployment. The remaining two continue to serve on a down-peak protocol evacuating occupants throughout the building. Fire fighters enter the elevator cabs and are able to proceed directly to the fire floor. Prior to the doors opening on the fire floor, the elevator cab polls the sensors on that particular floor and verifies that the ambient conditions (e.g., temperature, and noxious gas levels) are safe to allow for the fire fighters to exit the elevator.

The elevator door then opens and a fire fighter encounters light smoke and finds that this section of the floor is still under construction. He surmises that this must be the cause of the sprinkler system failure that he learned about en route to the fire. Based upon the awareness of the construction activity, he deduces that the cause of the sprinkler failure is most likely a result of it simply being bypassed locally and communicates this information to command. Command then passes this information to the team already evaluating the situation. Additionally, a construction-related opening had allowed the fire to extend to an elevator mechanical room in the floor above. The fire fighters proceeded to initiate fire attack on that floor and alerted command to deploy additional man power for the $16^{th}$ floor. With the combination of the building sprinkler system and hose lines, they were able to get control of the fire relatively quickly on the $15^{th}$ floor.

As a result of the fire extending to the sixteenth floor, the low-rise elevators no longer have power from the mechanical room. The RT-FG-SA system alerts Command that one elevator bank is now incapacitated and has at least one occupied elevator cab. Command sends an additional company to respond. The system allows the elevator occupants to communicate easily with the fire fighters and are relieved to know help is on the way. The crew chief arrives in the first floor elevator lobby and wirelessly communicates with each elevator cab in order to determine which elevator potentially contained stranded building occupants. Once it was verified that elevator #4 was occupied, the company officer issues a wireless command to that elevator cab to engage it's secondary on-board drive system and self-lower to the building lobby.

As a result of the non-working HVAC room on the fifteenth floor, the positive pressure was lost for the East stairway. Confused building occupants still remaining on floors 17 and above were able to see on the real-time system signage displays that the use of that stairway was not advisable and that in fact their safest route was elevators number 1 and number 2.

Example 2

A fire occurs on a holiday in a one-story, 50,000 sq. ft. building supply warehouse store in which no building sensor technology has been installed. Juvenile vandals, assumed to be the perpetrators of the fire, were not seen leaving the scene. A portion of the building supply's propane inventory which was stored outside on the loading dock has exploded, causing the collapse of a section of the western wall of the building. Immediately adjacent to that wall is the lumber department and the main standpipe. The pipe was broken and an inferno ensued. Importantly, the steel construction of the building prevents radios and network nodes inside the building from effectively communicating with network nodes and radios and receivers outside the building.

In order to overcome the structural interference with the mesh network communication, the search and rescue crew enters the building and deploys expendable ZShield™ fortified wireless sensor/transceiver nodes. The primary purpose of the use and placement of the expendable nodes is to insure uninterrupted connection to the outside. The expendable nodes serve as electronic "breadcrumbs" providing a communication lifeline to the outside of the warehouse. The sensor/transceiver nodes are in communication with the mesh network including devices capable of displaying recorded network information on the face plate or visor of a fire fighters helmet ("heads-up display"). Additionally, the system fully supports verbal and alarm bidirectional communication between crewmembers, on both their heads-up display and their forearm mounted panel.

The fire then spreads to a section of the supply store containing its Paint Department, and a flashover results. Fire fighters One and Two were immediately adjacent to the area and encountered the full brunt of the flashover. Debris from a nearby aisle ignited and the temperature quickly rose from 200° F. to 1000° F. Both fire fighters were knocked to the ground. Sensor nodes located in the fire fighters turn-out-gear (Fire Team Link™), transmitted this information to both the nearby crew via their team link nodes and heads up display, and also to the command node. In response to the notification that that Fire fighters One and Two were down, a nearby crew member was able to order deployment of second and third hose-lines, and was able to reach and rescue the downed fire fighters in less than four minutes. When part of the roof collapsed over the lumber department, two adjacent companies were able to locate and track each of their own crewmates via the mesh network and heads-up display.

Upon learning that the juvenile vandals were not seen leaving the scene of the fire, it was presumed that they were somewhere in the building supply store. A tactical crew was deployed which was equipped with ZShield™ blankets. Three teen vandals were found in the break room of the building supply store but there was no time to deploy and additional hose line. A tactical decision was made to keep the majority of the manpower fighting the front and to extract the teens using the ZShield™ blankets. The tactical team was able to wrap each of the teens in a blanket and carry them through 200-500° F. heat to safety.

The current invention provides intelligent facility and fireground management systems which are efficient, assure pedestrian and appliance safety and precise performance in emergency situations, regulatory compliance, easy and flexible integration with building systems and add-on components, as well as advanced internal component monitoring and event logging. Those skilled in the art will recognize, or be able to ascertain, many equivalents to the embodiments of the inventions described herein using no more than routine experimentation. Such equivalents are intended to be encompassed by the following claims.

All publications, patents and patent applications mentioned in this specification are herein incorporated by reference into the specification to the same extent as if each individual publication, patent or patent application was specifically and individually indicated to be incorporated herein by reference.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A facility and fireground management system comprising:

a structure;

a first barrier coupled to the structure, wherein the first barrier selectively moves between a first open position and a first closed position in response to a corresponding first control signal;

a second barrier coupled to the structure, wherein the second barrier selectively moves between a second open position and a second closed position in response to a corresponding a second control signal;

a first sensing device coupled to the first barrier and configured to obtain a first ambient information relating to a first area around the first barrier;

a second sensing device coupled to the second barrier and configured to obtain a second ambient information relating to a second area around the second barrier;

a first controller coupled to the first barrier and a second controller coupled to the second barrier, wherein the first controller instructs the first barrier to move from the open position to the closed position in response to the second ambient information while the second controller instructs the second barrier to move from the closed position to the open position.

2. The system of claim 1 further comprising a host computer coupled to the first and second controllers for controlling the first and second controllers.

3. The system of claim 2, wherein the first controller further includes:

a first local processor configured to provide the first control signal;

a first communication device coupled to the first local processor and configured to provide communications between the first local processor and the host computer; and a first local storage device coupled to the first local processor and configured to store at least a portion of history logging, terminal services, calendar service and ambient information relating to the first door.

4. The system of claim 3, wherein the first local processor is a microprocessor that is capable of executing instructions.

5. The system of claim 3, wherein the first communication device provides wireless communications between the local processor and the host computer.

6. The system of claim 3, wherein the host computer is capable of instructing the first local processor to instruct the first barrier to open or close in response to ambient information obtained by a sensing device associated to a second barrier not associated with the first local processor.

7. The system of claim 2, wherein the host computer is in wireless communication with the first and second controllers.

8. The system of claim 1, wherein each sensing device and each controller is thermally fortified.

9. The system of claim 8, wherein the first sensing device, second sensing device and controller are thermally fortified to function within a temperature range between about −40 degrees and about 2000 degrees Fahrenheit.

10. The system of claim 1, wherein each sensing device further comprises a status sensor for detecting status of the corresponding barrier.

11. The system of claim 1, wherein each sensing device further comprises:

a temperature sensor for detecting ambient temperature of the corresponding barrier.

12. The system of claim 1, wherein each sensing device further comprises a sensor for sensing a substance selected from the group consisting of oxygen, carbon monoxide, and carbon dioxide, chlorine, cyanogen, fluorine, hydrogen cyanide, nitric oxide, nitrogen tetraoxide and phosgene.

13. The system of claim 1, wherein each controller is configured to process a Doppler radar signal.

14. The system of claim 1 wherein the first sensing device further includes:

a temperature sensor for detecting ambient temperature of the first barrier; and a status sensor for detecting status of the first barrier.

15. The system of claim 1, wherein the first sensing device and second sensing device are expendable.

16. The system of claim 1, wherein the controller comprises a printed circuit board configured to function within a temperature range of at least −20 to 80 degrees Celsius.

17. The system of claim 1, further comprising a hydraulic device to move the first barrier between an open and closed position.

18. The system of claim 1, wherein the hydraulic device comprises a hydraulic cylinder, hydraulic hoses, a hydraulic pump, a multi-valve electrical mechanical hydraulic control and a sealed hydraulic reservoir.

19. The system of claim 18, wherein the sealed hydraulic reservoir is a regenerative reservoir.

20. The system of claim 1, wherein the controller is configured to perform barrier mode priority conflict management.

21. The system of claim 20, wherein the barrier mode priority conflict management comprises conflicting priorities of barrier management and pedestrian access.

22. The system of claim 1, wherein the controller is configured to resolve conflicting priorities of barrier and appliance management versus pedestrian access.

23. The system of claim 22, wherein the controller resolves the conflicting priorities based on door mode priority conflict management design criteria and user priority conflict management design criteria.

24. The system of claim 1, further comprising an absolute encoder configured to determine the position of the barrier.

25. The system of claim 1, wherein the first controller controls the second controller based on at least one of the first ambient information and the second ambient information.

26. The system of claim 1, wherein the first controller communicates the first ambient information to the second controller.

27. The system of claim 1, wherein the second controller communicates the second ambient information to the first controller.

* * * * *

UNITED STATES PATENT AND TRADEMARK OFFICE

CERTIFICATE OF CORRECTION

PATENT NO. : 7,965,178 B1
APPLICATION NO. : 11/714392
DATED : June 21, 2011
INVENTOR(S) : Bruce E. Schmutter et al.

It is certified that error appears in the above-identified patent and that said Letters Patent is hereby corrected as shown below:

Title Page, Item (76) Inventors,
Please replace the first inventor's last name "Schmuttor" with --Schmutter--.

Signed and Sealed this
Sixteenth Day of August, 2011

David J. Kappos

David J. Kappos
*Director of the United States Patent and Trademark Office*